US010930204B2

(12) United States Patent
He

(10) Patent No.: US 10,930,204 B2
(45) Date of Patent: Feb. 23, 2021

(54) PIXEL CIRCUIT, DRIVE METHOD THEREOF AND DISPLAY PANEL

(71) Applicant: Shanghai Tianma Micro-Electronics Co., Ltd., Shanghai (CN)

(72) Inventor: Zeshang He, Shanghai (CN)

(73) Assignee: Shanghai Tianma Micro-Electronics Co., Ltd., Shanhai (CN)

( * ) Notice: Subject to any disclaimer, the term of this patent is extended or adjusted under 35 U.S.C. 154(b) by 0 days.

(21) Appl. No.: 16/653,471

(22) Filed: Oct. 15, 2019

(65) Prior Publication Data

US 2020/0380910 A1 Dec. 3, 2020

(30) Foreign Application Priority Data

May 30, 2019 (CN) ..... 201910465632.8

(51) Int. Cl.
*G09G 3/32* (2016.01)

(52) U.S. Cl.
CPC ..... *G09G 3/32* (2013.01); *G09G 2310/027* (2013.01); *G09G 2310/0267* (2013.01); *G09G 2310/0272* (2013.01); *G09G 2310/0278* (2013.01)

(58) Field of Classification Search
CPC combination set(s) only.
See application file for complete search history.

(56) References Cited

U.S. PATENT DOCUMENTS

2005/0156828 A1 7/2005 Yamashita et al.
2014/0347332 A1* 11/2014 Lee ..... G09G 3/3233 345/204
2019/0198582 A1* 6/2019 Yeo ..... H01L 27/3223

FOREIGN PATENT DOCUMENTS

CN 102113216 A 6/2011
CN 106469539 A 3/2017
CN 109272940 A 1/2019

* cited by examiner

*Primary Examiner* — Deeprose Subedi
(74) *Attorney, Agent, or Firm* — von Briesen & Roper, s.c.

(57) ABSTRACT

Disclosed are a pixel circuit, a drive method thereof and a display panel. The pixel circuit includes: a discharge module, a storage module, a comparison module, and a drive module. The drive module is configured to drive, according to a voltage outputted through the output end of the comparison module, a light-emitting module to emit light. In a light-emitting phase, the discharge module discharges the storage module; and the comparison module compares an input voltage received from the first input end with a reference voltage received from the second input end and outputs, to the control end of the drive module, a constant voltage for turning on the drive module or a voltage for turning off the drive module, so that the drive module generates a constant drive current when being turned on.

17 Claims, 14 Drawing Sheets

PIXEL CIRCUIT, DRIVE METHOD THEREOF AND DISPLAY PANEL

CROSS-REFERENCES TO RELATED APPLICATIONS

This application claims priority to Chinese patent application No. CN201910465632.8 filed at CNIPA on May 30, 2019, the disclosure of which is incorporated herein by reference in its entirety.

TECHNICAL FIELD

This application relates to the field of display technologies and, in particular, to a pixel circuit, a drive method thereof and a display panel.

BACKGROUND

With the development of display technology, an inorganic light-emitting diode display panel, such as a micro light-emitting diode (micro LED) display panel, is more and more widely used due to its advantages of high luminance, good luminous efficiency, and low power consumption.

The inorganic light-emitting diode display panel includes a pixel circuit for driving the inorganic light-emitting diode to emit light. In the related art, the display gray scale of the inorganic light-emitting diode is controlled by a drive current generated by a drive transistor of the pixel circuit, and the drive current is controlled by a data voltage applied to a gate of the drive transistor. Different data voltages correspond to different display gray scales.

The inorganic light-emitting diode has a higher luminous efficiency when driven by a current with a large current density. However, with the pixel circuit in the related art, the high luminous efficiency of the inorganic light-emitting diode cannot be utilized in the low scale cases.

SUMMARY

The present disclosure provides a pixel circuit, a drive method thereof and a display panel, in order to fully utilize the high luminous efficiency of the inorganic light-emitting diode in the low gray scale cases.

According to a first aspect, an embodiment of the present disclosure provides a pixel circuit. The pixel circuit includes a data voltage write module, a storage module, a discharge module, a comparison module, a drive module, and a light-emitting module.

The data voltage write module is electrically connected to the storage module. The data voltage write module is configured to transmit a data voltage to the storage module. The storage module is configured to store the data voltage.

The discharge module is electrically connected to the storage module. The discharge module is configured to discharge the storage module.

The comparison module includes a first input end, a second input end and an output end. The first input end is electrically connected to a common end of the storage module and the discharge module. The second input end is configured to receive a reference voltage. The output end of the comparison module is electrically connected to a control end of the drive module.

The drive module is electrically connected to the light-emitting module. The drive module is configured to drive, according to a voltage output through the output end of the comparison module, the light-emitting module to emit light.

According to a second aspect, an embodiment of the present disclosure provides a display panel. The display panel includes a plurality of pixel circuits, a plurality of scan lines, a plurality of data lines, a plurality of first voltage signal lines, a plurality of second voltage signal lines, a plurality of third voltage signal lines, a plurality of discharge control signal lines and a plurality of reference voltage lines.

Each pixel circuit includes a data voltage write module, a storage module, a discharge module, a comparison module, a drive module and a light-emitting module.

Each of the data voltage write module, the discharge module and the drive module includes a first end, a second end and a control end. Each of the storage module and the light-emitting module includes a first end and a second end. The comparison module includes a first input end, a second input end and an output end.

The control end of the data voltage write module is electrically connected to one scan line. The first end of the data voltage write module is electrically connected to one data line. The second end of the data voltage write module is electrically connected to the first end of the storage module.

The first end of the storage module is electrically connected to the first end of the discharge module. The second end of the storage module is electrically connected to one first voltage signal line. The control end of the discharge module is electrically connected to one discharge control signal line. The second end of the discharge module is electrically connected to one second voltage signal line.

The first input end of the comparison module is electrically connected to the first end of the storage module. The second input end of the comparison module is electrically connected to one reference voltage line. The output end of the comparison module is electrically connected to the control end of the drive module.

The first end of the drive module is electrically connected to one third voltage signal line. The second end of the drive module is electrically connected to the first end of the light-emitting module. The second end of the light-emitting module is electrically connected to one second voltage signal line.

According to a third aspect, an embodiment of the present disclosure provides a drive method for a pixel circuit. The pixel circuit includes a data voltage write module, a storage module, a discharge module, a comparison module, a drive module and a light-emitting module.

The data voltage write module is electrically connected to the storage module. The data voltage write module is configured to transmit a data voltage to the storage module. The storage module is configured to store the data voltage.

The discharge module is electrically connected to the storage module. The discharge module is configured to discharge the storage module.

The comparison module includes a first input end, a second input end and an output end. The first input end is electrically connected to a common end of the storage module and the discharge module. The second input end is configured to receive a reference voltage. The output end of the comparison module is electrically connected to a control end of the drive module.

The drive method includes the steps described below.

In a data write phase, the data voltage write module is turned on, and the data voltage is written to the storage module by the data voltage write module.

In a light-emitting phase, the data voltage write module is turned off; the discharge module discharges the storage module; the comparison module outputs a first voltage or a second voltage to the control end of the drive module; the drive module outputs, upon receiving the first voltage, a drive current to drive the light-emitting module to emit light, and is turned off upon receiving the second voltage.

The present disclosure provides a pixel circuit, a drive method thereof and a display panel. The pixel circuit includes a data voltage write module, a storage module, a discharge module, a comparison module, a drive module, and a light-emitting module. The discharge module is electrically connected to the storage module. The comparison module includes a first input end, a second input end and an output end. The first input end is electrically connected to a common end of the storage module and the discharge module. The second input end is configured to receive a reference voltage. The output end of the comparison module is electrically connected to a control end of the drive module. In the light-emitting phase, the discharge module discharges the storage module; and the comparison module compares the voltage received from the first input end with the reference voltage received from the second input end and outputs a constant voltage for turning on the drive module or a constant voltage turning off the drive module, so that the drive module generates a constant drive current when being turned on. Since different data voltages correspond to different display gray scales, different conduction durations of the drive module correspond to different gray scales. The display gray scale of the light-emitting module is controlled by the conduction duration of the drive module, namely the light emission duration for the light-emitting module. The comparison module is configured to generate a constant voltage for different gray scales, the constant voltage is applied to the control end of the drive module, and the drive module generates a large drive current. Different gray scales are implemented by the constant large drive current and different conduction durations of the drive module. The high luminous efficiency advantage of the inorganic light-emitting diode can be fully utilized in the low gray scale cases. In this way, the luminous efficiency of the inorganic light-emitting diode can be relatively high in any gray scale.

DETAILED DESCRIPTION

Figure 1:
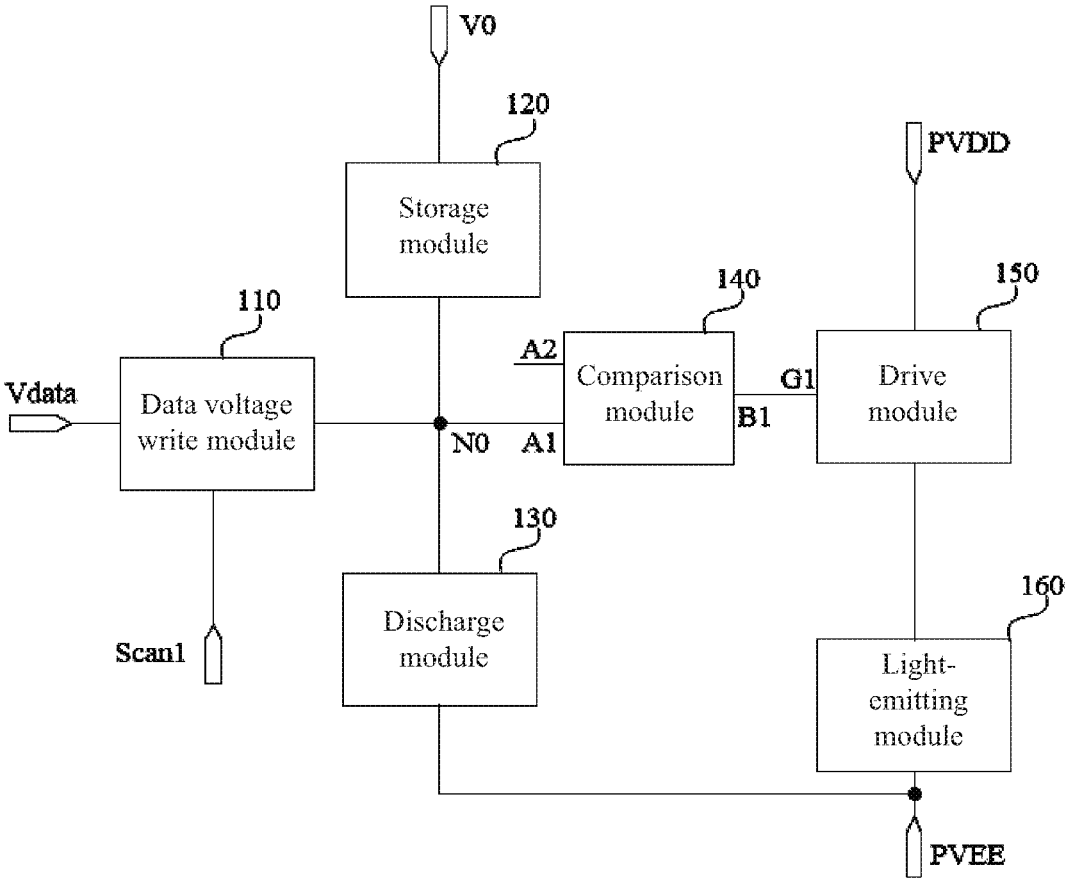
FIG. 1 is a block diagram of a pixel circuit according to an embodiment of the present disclosure.

Hereinafter the present disclosure will be further described in detail in conjunction with the drawings and embodiments. It is to be understood that the specific embodiments set forth below are intended to illustrate and not to limit the present disclosure. Additionally, it is to be noted that, for ease of description, only part, not all, of the structures related to the present disclosure are illustrated in the drawings.

The luminous efficiency of the inorganic light-emitting diode decreases as the decreasing of the current density of the drive current of the inorganic light-emitting diode. As described in the background, in the related art, the display gray scale of the inorganic light-emitting diode is modulated by the current density of the drive current, that is, the display gray scale of the inorganic light-emitting diode is controlled by the magnitude of the drive current, and the magnitude of the drive current is controlled by the data voltage applied to the gate of the drive transistor, and different gray scales need different data voltages. This drive mode cannot fully utilize the high luminous efficiency of the inorganic light-emitting diode in the low gray scale cases. This is because, in the related pixel circuit, the display gray scale of the inorganic light-emitting diode is determined by the magnitude of the drive current, a low gray scale is implemented by a small drive current, and the luminous efficiency is low in low gray scale cases. For example, to achieve a low gray scale, the data voltage applied to the gate of the drive transistor is relatively low, the drive current generated by the drive transistor is relatively small, and thus the current flowing through the inorganic light-emitting diode is relatively small. In this case, the luminous efficiency of the inorganic light-emitting diode is relatively low. The high luminous efficiency of the inorganic light-emitting diode cannot be fully utilized. Moreover, the luminance of the inorganic light-emitting diode is determined by the magnitude of the drive current and the luminous efficiency. For the low-gray-scale range, the low luminous efficiency of the inorganic light-emitting diode may cause the actual display luminance is lower than the expected luminance, thereby affecting the display effect.

An embodiment of the present disclosure provides a pixel circuit. FIG. 1 is a block diagram of the pixel circuit according to an embodiment of the present disclosure. As shown in FIG. 1, the pixel circuit includes a data voltage write module 110, a storage module 120, a discharge module 130, a comparison module 140, a drive module 150 and a light-emitting module 160.

The data voltage write module 110 is electrically connected to the storage module 120. The data voltage write module 110 is configured to transmit a data voltage to the storage module 120. The storage module 120 is configured to store the data voltage.

The discharge module 130 is electrically connected to the storage module 120. The discharge module 130 is configured to discharge the storage module 120.

The comparison module 140 includes a first input end A1, a second input end A2 and an output end B1. The first input end A1 is electrically connected to the common end N0. Both the storage module 120 and the discharge module 130 are electrically connected to the common end N0. The comparison module 140 is configured to receive a reference voltage through the second input end A2. The output end B1 of the comparison module 140 is electrically connected to a control end G1 of the drive module 150.

The drive module 150 is electrically connected to the light-emitting module 160. The drive module is configured to drive, according to the voltage output through the output end B1 of the comparison module 140, the light-emitting module to emit light.

As shown in FIG. 1, the data voltage write module 110 is connected to the storage module 120. The storage module 120 may store the data voltage received from the data voltage write module 110. The storage module 120 is further electrically connected to the discharge module 130. The storage module 120 is further electrically connected to the first input end A1 of the comparison module 140. The comparison module outputs a drive voltage to the control end G1 of the drive module 150 according to a voltage received through the first input end A1 and a reference voltage received through the second input end A2. The reference voltage may be lower than the data voltage for any gray scale of the light-emitting module.

The operating timing of the pixel circuit may include a data write phase and a light-emitting phase. In the data write phase, the data voltage write module 110 is turned on and transmits the data voltage to the storage module 120; and the storage module 120 stores the data voltage.

After the data voltage is written into the storage module 120, the light-emitting phase begins. In the light-emitting phase, the data voltage write module 110 is turned off, and the discharge module 130 is turned on. The discharge module 130 discharges the storage module gradually, so the data voltage written to the storage module 120 by the data voltage write module 110 starts to gradually decrease. Since the first input end A1 of the comparison module 140 is electrically connected to the common end of the storage module 120 and the discharge module 130, the voltage at the first input end A1 starts to gradually decrease. When the voltage at the first input end A1 is higher than the reference voltage at the second input end A2, the comparison module 140 may output a constant voltage for turning on the drive module 150. In this way, when the voltage at the first input end A1 is higher than the reference voltage at the second input end A2, the drive module 150 is turned on, and the drive current generated by the drive module 150 is constant. The light-emitting module 160 emits light, and the luminance of the light is constant. As the discharge process progresses, the voltage at the first input end A1 of the comparison module 140 gradually decreases. When the voltage at the first input end A1 is lower than the reference voltage applied to the second input end A2, the comparison module 140 may output a constant voltage for turning off the drive module 150. In this way, when the voltage at the first input end A1 is lower than the reference voltage at the second input end A2, the drive module 150 is kept in the off state and no longer drives the light-emitting module 160 to emit light.

According to the embodiment of the present disclosure, the magnitude of the data voltage still corresponds to the display gray scale. For different display gray scales, the data voltages transmitted to the storage module 120 by the data voltage write module 110 are different in magnitude. However, when the voltage at the first input end A1 of the comparison module 140 is higher than the reference voltage at the second input end A2, the comparison module 140 outputs a constant voltage for turning on the drive module 150, that is, the potential of the control end of the drive module 150 is constant for different display gray scales, so that the drive current flowing through the light-emitting module 160 is constant for different display gray scales, that is, a constant current drive for the light-emitting module 160 can be achieved. The magnitude of the constant drive current is determined by the voltage output by the comparison module 140. Therefore, the drive current generated by the drive module 150 can be controlled by controlling the constant drive voltage output by the comparison module 140.

Since the data voltages corresponding to different gray scales are different, when the discharge module 130 discharges the storage module 120, the durations for discharging the data voltages corresponding to different gray scales to the magnitude of the reference voltage are also different. In this way, for different data voltages, the durations of the constant voltage outputted by the comparison module 140 are also different, and the light emission durations of the light-emitting module 160 are different. That is, in the pixel circuit according to the embodiment of the present disclosure, the magnitude of the data voltage determines the conduction duration of the drive module, and the display gray scale is modulated through the light emission duration of the light-emitting module 160 instead of through the magnitude of the drive current. As described earlier, according to the embodiment of the present disclosure, when the light-emitting module 160 emits light, the drive current flowing through the light-emitting module 160 is constant.

In one or more embodiments, the light-emitting module 160 is an inorganic light-emitting diode. For example, the light-emitting module 160 may be a Micro-LED. The comparison module 140 outputs a constant drive voltage to the drive module 150, and the drive module 150 is turned on by the constant drive voltage and generates a large drive current. For different gray scales, the comparison module 140 outputs the same constant drive voltage to the drive module 150, so that the high luminous efficiency of the inorganic light-emitting diode can be fully utilized accordingly. In this way, the luminous efficiency of the inorganic light-emitting diode is high in any gray scale including the low gray scale, and thereby the display effect is prevented from being affected by the undesired luminance due to the low light emission efficiency caused by small drive current.

The pixel circuit of the present disclosure includes a data voltage write module, a storage module, a discharge module, a comparison module, a drive module and a light-emitting module. The discharge module is electrically connected to the storage module. The comparison module includes a first input end, a second input end and an output end. The first input end is electrically connected to a common end of the storage module and the discharge module. The second input end is configured to receive a reference voltage. The output end of the comparison module is electrically connected to a control end of the drive module. In the light-emitting phase, the discharge module discharges the storage module; and the comparison module compares the voltage at the first input end with the reference voltage at the second input end and outputs a constant voltage for turning on or turning off the drive module to the control end of the drive module, so that the drive module has a constant drive current when turned on. Since data voltages corresponding to different display gray scales are different, the turned-on durations of the drive module may be different in different gray scales. The display gray scale of the light-emitting module is controlled by the turned-on duration of the drive module, namely the light emission duration of the light-emitting module. With the constant drive voltage outputted by the comparison module, the drive module has a relatively large drive current. The high luminous efficiency of the inorganic light-emitting diode can be fully utilized accordingly. In this way, the luminous efficiency of the inorganic light-emitting diode can be relatively high in any gray scale including the low gray scale.

The above-mentioned is a core idea of this disclosure. The technical solutions in embodiments if the present disclosure will be described clearly and completely in conjunction with the drawings in the embodiments of the present disclosure. Apparently, the embodiments described below are part, not all of the embodiments of the present disclosure. Based on the embodiments of the present disclosure, all other embodiments obtained by those skilled in the art without making creative work are within the scope of the present disclosure.

In one or more embodiments, the voltage outputted through the output end B1 of the comparison module 140 includes a first voltage and a second voltage. When the output end B1 of the comparison module 140 outputs the first voltage, the drive module 150 is turned on. When the output end B1 of the comparison module 140 outputs the second voltage, the drive module 150 is turned off. In one or more embodiments, when the voltage at the first input end A1 is higher than the reference voltage at the second input end A2, the comparison module 140 outputs the first voltage, and, upon receiving the first voltage, the drive module 150 is turned on to drive the light-emitting module 160 to emit light. When the voltage at the first input end A1 is lower than the reference voltage at the second input terminal A2, the comparison module 140 outputs the second voltage, and, upon receiving the second voltage, the drive module 150 is turned off and thereby cannot drive the light-emitting module 160 to emit light. When the light-emitting module 160 is an inorganic light-emitting diode, the magnitude of the first voltage output by the comparison module 140 is controlled to make the drive module 150 to generate a large drive voltage, so that the high efficiency of the inorganic light-emitting diode can be fully utilized.

Figure 2:
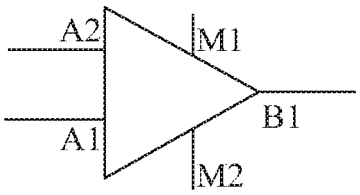
FIG. 2 is a schematic diagram of a comparator according to an embodiment of the present disclosure.
Figure 3:
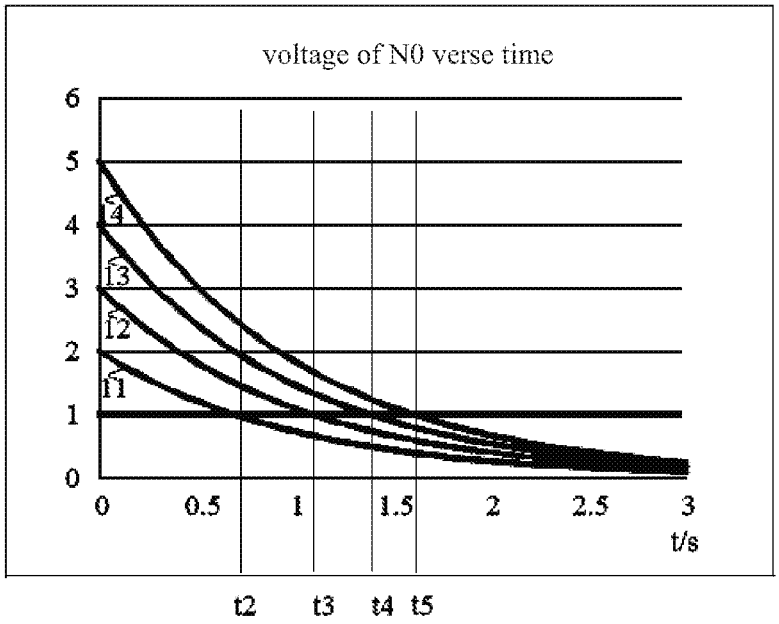
FIG. 3 is a graph of a voltage of a common node NO between a storage module and a discharge module over time according to an embodiment of the present disclosure.
Figure 4:
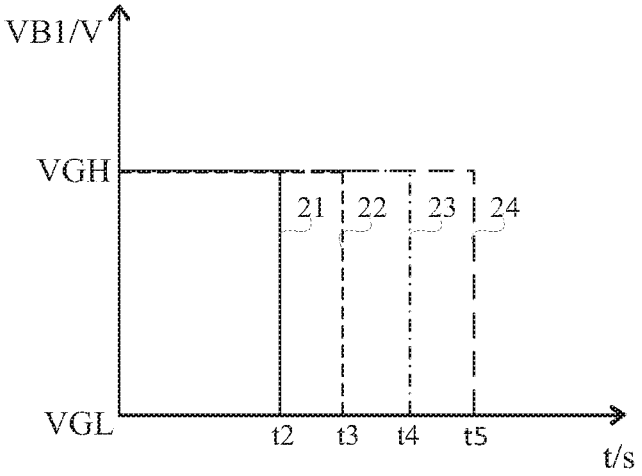
FIG. 4 is a graph of a voltage outputted through an output end of a comparison module over time according to an embodiment of the present disclosure.

In the present disclosure, the comparison module 140 may be any comparator capable of providing the function of outputting the first voltage when the voltage at the first input end A1 is higher than the reference voltage at the second input end A2 and outputting the second voltage when the voltage at the first input terminal A1 is lower than the reference voltage at the second input terminal A2. FIG. 2 is a schematic diagram of an exemplary comparator according to an embodiment of the present disclosure. As shown in FIG. 2, the comparator includes a first input end A1, a second input end A2, a first end M1, a second end M2 and an output end B1. The second input end A2 receives the reference voltage. The first end M1 receives a first voltage VGH and the second end M2 receives a second voltage VGL. FIG. 3 is a graph of the voltage of the common node N0 of the storage module and the discharge module over time according to an embodiment of the present disclosure. FIG. 4 is a graph of the voltage outputted through the output end of the comparison module over time according to an embodiment of the present disclosure. FIG. 3 and FIG. 4 illustrate examples in which the reference voltage is 1V and the data voltages transmitted by the data voltage e module 110 to the storage module 120 are 2V, 3V, 4V and 5V respectively. As shown in FIG. 3, according to the curve 11 corresponding to the case where the data voltage write module 110 transmits the 2V data voltage to the storage module 120, the duration for the 2V voltage stored in the storage module 120 to decrease to the reference voltage 1V through the discharge of the discharge module 130 is t2. The curve 12 corresponds to the case where the voltage write module 110 transmits the 3V data voltage to the storage module 120. As shown in FIG. 3, the duration for the 3V voltage stored in the storage module 120 to decrease to the reference voltage 1V through the discharge of the discharge module 130 is t3. According to the curve 13 corresponding to the case where the data voltage write module 110 transmits the 4V data voltage to the storage module 120, the duration for the 4V voltage stored in the storage module 120 decreases to the reference voltage 1V through the discharge of the discharge module 130 is t4. According to the curve 14 corresponding to the case where the data voltage write module 110 transmits the 5V data voltage to the storage module 120, the duration for the 5V voltage stored in the storage module 120 to decrease to the reference voltage 1V through the discharge of the discharge module 130 is t5. As shown in FIG. 3, $t2<t3<t4<t5$.

As shown in FIG. 3 and FIG. 4, VGH denotes the first voltage and VGL denotes the second voltage. In the output curve 21 of the comparator, the data voltage written to the storage module 120 is 2V. In the output curve 22 of the comparator, the data voltage written to the storage module 120 is 3V. In the output curve 23 of the comparator, the data voltage written to the storage module 120 is 4V. In the output curve 24 of the comparator, the data voltage written to the storage module 120 is 5V. The durations of the first voltage outputted by the comparator, when the data voltages written to the storage module 120 are 2V, 3V, 4V and 5V, are t2, t3, t4, and t5, respectively, where $t2<t3<t4<t5$. The higher the data voltage written into the storage module 120 is, the longer the duration of the first voltage VGH outputted by the comparator to the control end of the drive module 150 is, the longer the turned-on duration of the drive module 150 is, and the longer the light emission duration of the light-emitting module 160 is.

It should be noted that, in FIG. 4, the drive module 150 is turned on when the comparator outputs a higher voltage, for example, the drive module 150 is an N-type transistor. In some other cases, the drive module 150 may be turned on when the comparator outputs a lower voltage, for example, the drive module 150 is a P-type transistor. That is, when the drive module 150 is an N-type transistor, the first voltage is a high voltage and the second voltage is a low voltage; when the drive module 150 is a P-type transistor, the first voltage is a low voltage and the second voltage is a high voltage.

Figure 5:
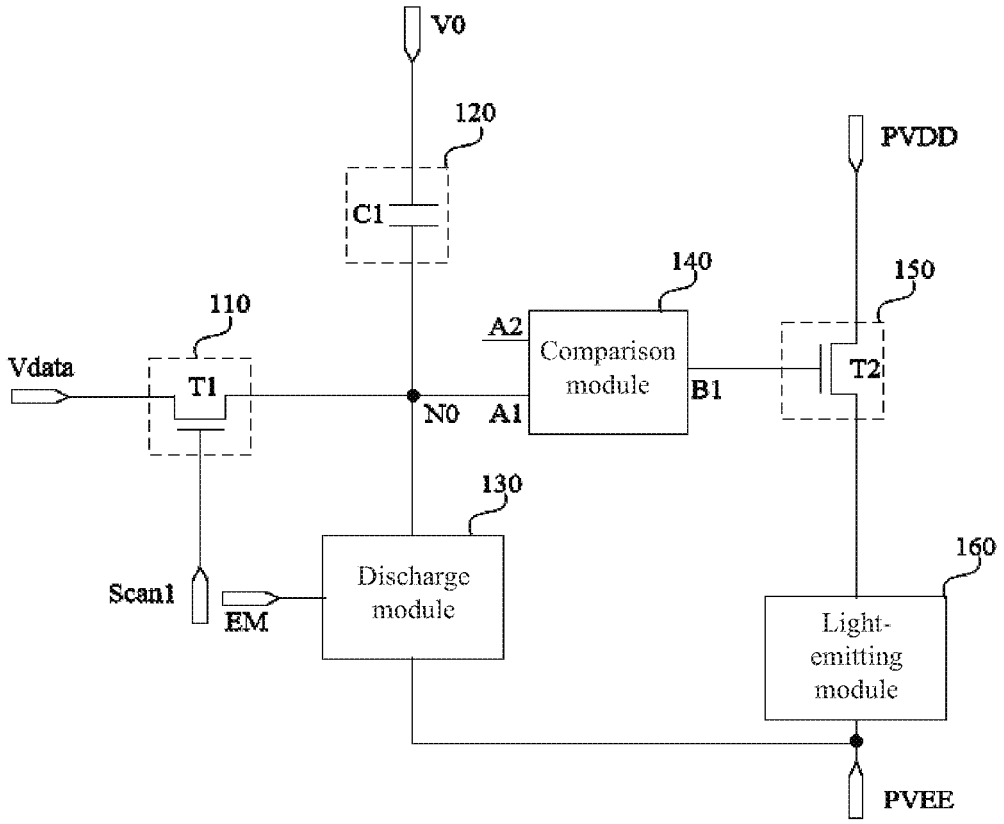
FIG. 5 is a schematic diagram of another pixel circuit according to an embodiment of the present disclosure.

FIG. 5 is a schematic diagram of another pixel circuit according to an embodiment of the present disclosure. As shown in FIG. 5, the data voltage write module 110 includes a first transistor T1, the storage module 120 includes a first capacitor C1, and the drive module 150 includes a second transistor T2. The pixel circuit includes a first scan signal input end Scan1, a data voltage input end Vdata, a first voltage signal input end V0, a second voltage signal input end PVEE, and a discharge control signal input end EM.

A gate of the first transistor T1 is electrically connected to the first scan signal input end Scan1. A first electrode of the first transistor T1 is electrically connected to the data voltage input end Vdata. A second electrode of the first transistor T1 is electrically connected to a first end of the first capacitor C1.

The first end of the first capacitor C1 is also electrically connected to a first end of the discharge module 130. A second end of the first capacitor C1 is electrically connected to the first voltage signal input end V0. A second end of the discharge module 130 is electrically connected to the second voltage signal input end PVEE, and a control end of the discharge module 130 is electrically connected to the discharge control signal input end EM of the pixel circuit.

The first input end A1 of the comparison module 140 is electrically connected to the first end of the first capacitor C1. The output end B1 of the comparison module 140 is electrically connected to the gate of the second transistor T2. The first electrode of the second transistor T2 is electrically connected to a third voltage signal input end PVDD of the pixel circuit. The second electrode of the second transistor T2 is electrically connected to a first end of the light-emitting module 160. A second end of the light-emitting module 160 is electrically connected to the second voltage signal input end PVEE of the pixel circuit.

Figure 6:
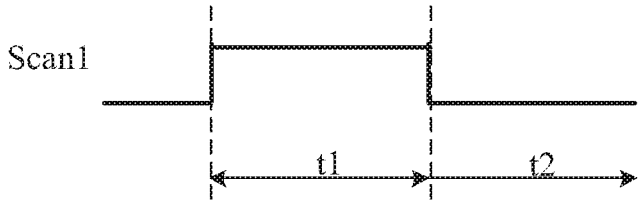
FIG. 6 is a diagram of an operating timing of a pixel circuit according to an embodiment of the present disclosure.

The first transistor T1 and the second transistor T2 may be P-type transistors or N-type transistors. The following describes an example in which the first transistor T1 and the second transistor T2 are both N-type transistors. FIG. 6 is a diagram showing an operating timing of a pixel circuit according to an embodiment of the present disclosure, and the operating timing may correspond to the pixel circuit in FIG. 5. As shown in FIG. 5 and FIG. 6, the operating timing of the pixel circuit illustrated in FIG. 5 may include a data write phase t1 and a light-emitting phase t2. In the data write phase t1, a high level signal is received through the first scan signal input end Scan1, the first transistor T1 is turned on, the data voltage received through the data voltage input end. Vdata is transmitted to the first end of the first capacitor C1 by the turned-on first transistor T1, and the first capacitor C1 stores the data voltage. In the light-emitting phase t2, a low level signal is received through the first scan signal input end Scan1, the first transistor T1 is turned off. Moreover, in the light-emitting phase t2, the discharge module 130 is turned on by the signal received through the discharge control signal input end EM, the discharge module 130 discharges the first capacitor C1, and the potential of the common node NO of the first capacitor C1 and the discharge module 130 gradually decreases. Accordingly, the voltage at the first input end A1 of the comparison module 140 gradually decreases. The output voltage of the comparison module 140 is determined by the voltage at the first input end A1 and the reference voltage at the second input end A2. The output voltage of the comparison module 140 includes a first voltage and a second voltage. When the first voltage is applied to the gate of the second transistor T2, the second transistor T2 is turned on to drive the light-emitting module 160 to emit light. The second transistor T2 serves as the drive transistor of the pixel circuit. The first electrode of the second transistor T2 (which may be the source of the second transistor T2) is electrically connected to the third voltage signal input terminal PVDD of the pixel circuit, that is, the voltage at the first electrode of the second transistor T2 is fixed. The first voltage applied to the gate of the drive transistor is also constant. The current of the drive transistor can be calculated according to the following formula:

$$I = \frac{1}{2}\mathrm{Cox}\mu\frac{W}{L}(VGS - Vth)^2 = \frac{1}{2}\mathrm{Cox}\mu\frac{W}{L}(VG\text{-}VS - Vth)^2,$$

where Cox denotes the gate oxide capacitance (the capacitance of the gate oxide per unit area), μ denotes the carrier mobility, $$\frac{W}{L}$$

denotes the width to length ratio of the drive transistor, VGS denotes the voltage difference between the gate and the source of the drive transistor, VG denotes the gate voltage of the drive transistor, VS denotes the source voltage of the drive transistor, and Vth denotes the threshold voltage of the drive transistor. As shown in the above formula, when the gate voltage and the source voltage are fixed, the drive current of the drive transistor is constant, and thus a constant current drive can be achieved. Moreover, when the discharge module 130 discharges the first capacitor C1, the durations for the voltage of the first capacitor C1 to decrease below the reference voltage are different for different data voltages corresponding to different gray scales. In this way, the display gray scale may be modulated through the light emission duration of the light-emitting module 160.

It should be noted that, the second end of the discharge module 130 and the light-emitting module 160 may be connected to different voltage signal input ends, and this connection mode is not limited in the present disclosure.

Figure 7:
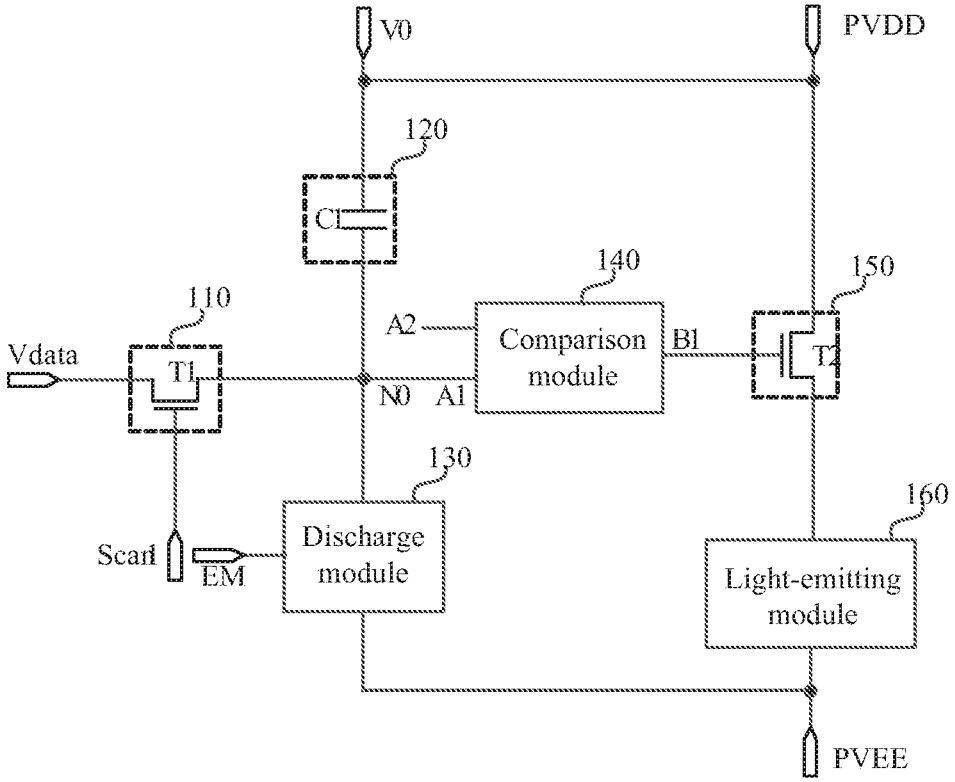
FIG. 7 is a schematic diagram of another pixel circuit according to an embodiment of the present disclosure.

FIG. 7 is a schematic diagram of another pixel circuit according to an embodiment of the present disclosure. As shown in FIG. 7, the first voltage signal input end V0 is electrically connected to the third voltage signal input end PVDD, such that the first voltage signal input end V0 and the third voltage signal input end PVDD receive the same voltage. In this way, the first voltage signal input end V0 and the third voltage input end are connected to the same voltage signal line. This helps decrease the number of signal lines in the display panel and reduce the layout difficulty of the display panel.

Figure 8:
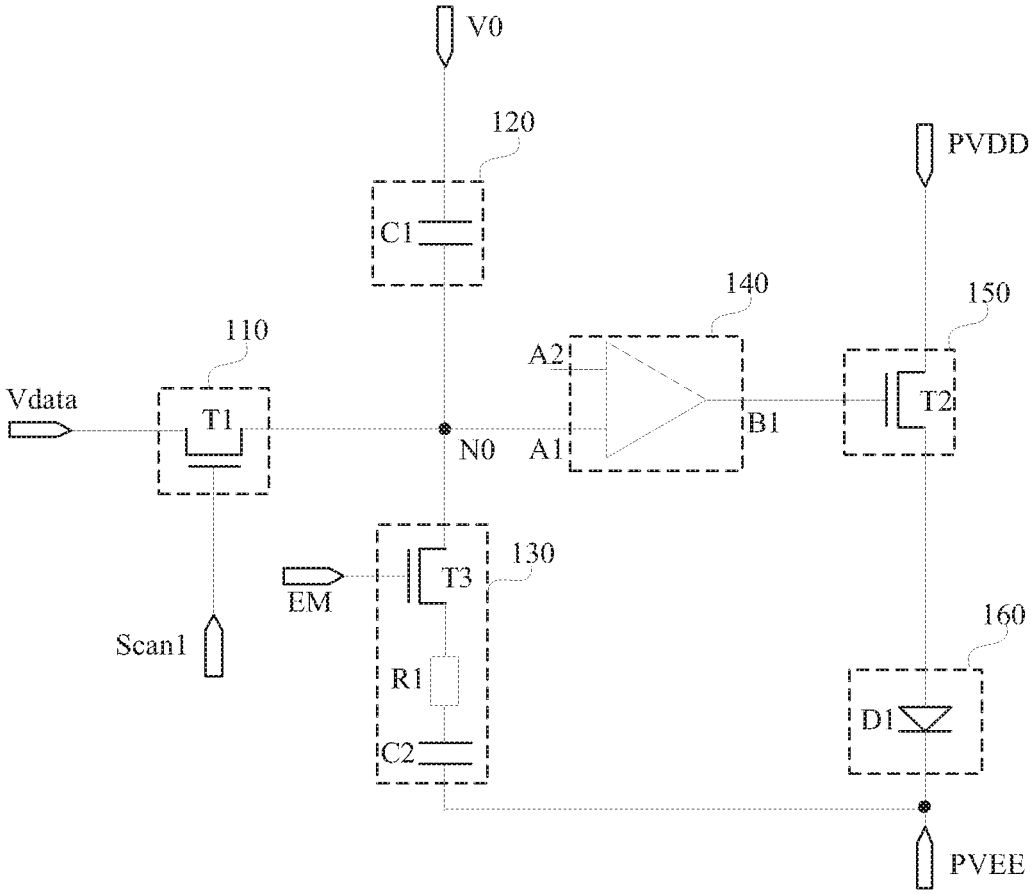
FIG. 8 is a schematic diagram of another pixel circuit according to an embodiment of the present disclosure.

FIG. 8 is a schematic diagram of another pixel circuit according to an embodiment of the present disclosure. As shown in FIG. 8, the discharge module 130 includes a third transistor T3, a first resistor R1 and a second capacitor C2 connected in series in sequence. The gate of the third transistor T3 serves as the control end of the discharge module 130 and is electrically connected to the discharge control signal input end EM of the pixel circuit. The first electrode of the third transistor T3 serves as the first end of the discharge module 130 and is electrically connected to the first end of the storage module 120. The second electrode of the third transistor T3 is electrically connected to the first end of the first resistor R1. The second end of the first resistor R1 is electrically connected to the first end of the second capacitor C2. The second end of the second capacitor C2 serves as the second end of the discharge module 130 and is electrically connected to the second voltage signal input end PVEE of the pixel circuit.

Figure 9:
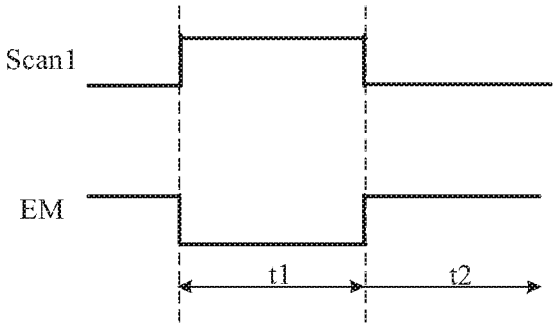
FIG. 9 is a diagram of an operating timing of a pixel circuit according to another embodiment of the present disclosure.

FIG. 8 illustrates an example in which the data voltage write module 110 includes a first transistor T1, the storage module 120 includes a first capacitor C1, the drive module 150 includes a second transistor T2, and the light-emitting module 160 includes an inorganic light-emitting diode D1. Each of the first transistor T1, the second transistor T2 and the third transistor T3 may be a P-type transistor or an N-type transistor. The following describes an example in which the first transistor T1, the second transistor T2 and the third transistor T3 are all N-type transistors. FIG. 9 is a diagram of an operating timing of a pixel circuit according to an embodiment of the present disclosure. The operating timing diagram may correspond to the pixel circuit in FIG. 8. As shown in FIG. 8 and FIG. 9, the operating timing of the pixel circuit illustrated in FIG. 8 may include a data write phase t1 and a light-emitting phase t2. In the data write phase t1, a high level signal is applied to the first scan signal input end Scan1, and the first transistor T1 is turned on, the first transistor T1 transmits the data voltage received through the data voltage input end Vdata to the first end of the first capacitor C1, and the first capacitor C1 stores the data voltage. In the light-emitting phase t2, a high level signal is applied to the discharge control signal input end EM, the third transistor T3 is turned on, and the RC circuit composed of the first resistor R1 and the second capacitor C2 discharges the storage module 120, In the pixel circuit according to the embodiment of the present disclosure, the discharge module 130 includes the third transistor T3, the first resistor R1 and the second capacitor C2, the discharge state of the first capacitor C1 is controlled by turning on or turning off the third transistor T3. Accordingly, the storage module 120 is discharged after the data voltage has been written into the storage module 120. In this way, the storage module 120 can be prevented from being insufficiently charged caused by the prematurely discharge started before the data voltage is written into the storage module 120 completely. Thereby, the light emission duration of the light-emitting module 160 corresponding to each gray scale can be accurately controlled and a good display effect is ensured.

Figure 10:
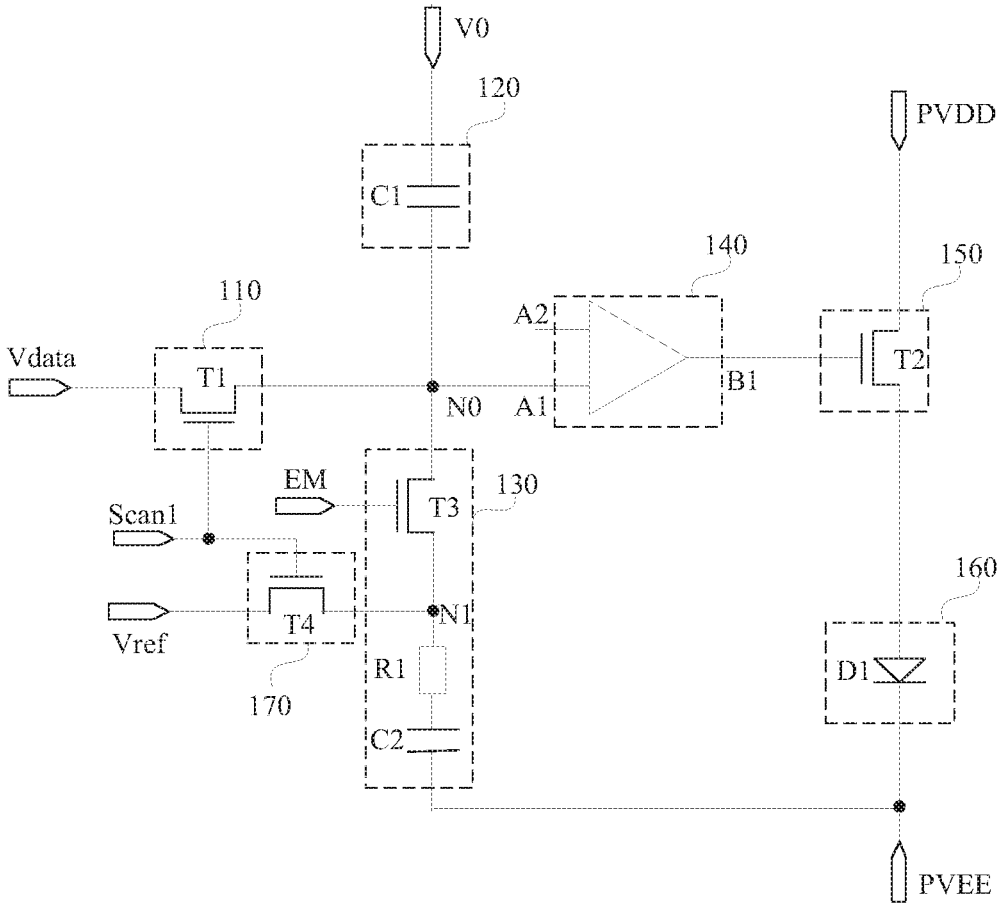
FIG. 10 is a schematic diagram of another pixel circuit according to an embodiment of the present disclosure.

FIG. 10 is a schematic diagram of another pixel circuit according to an embodiment of the present disclosure. As shown in FIG. 10, the pixel circuit further includes an initialization module 170. The initialization module 170 is electrically connected to the first end of the resistor R1 and configured to initialize the potential of the first end of the first resistor R1 namely the potential of the N1 node. In the pixel circuit including the initialization module 170, the initialization module 170 may initialize the potential of the first end of the first resistor R1, that is, the potential of the N1 node. In this way, in each frame, when the discharge of the storage module 120 starts, the potential of the first end of the first resistor R1, namely the potential of the N1 node, is consistent. This prevents the residual charge of the previous frame at the first end of the first resistor R1, namely the potential of the N1 node, which may affect the discharge duration. Accordingly, the current display frame is not affected by the residual charge of the previous frame. That is, the first end of the first resistor R1 does not have the residual charge of the previous frame during driving, so that a good display effect is ensured. The initialization of the first end of the first resistor R1 may be performed before the data write phase t1 or may be implemented with the data write phase t1.

As shown in FIG. 10, on the basis of the foregoing solution, the initialization module 170 includes a fourth transistor T4. The gate of the fourth transistor T4 is electrically connected to the first scan signal input end Scan1 of the pixel circuit. The first electrode of the fourth transistor T4 is electrically connected to an initialization voltage input end Vref of the pixel circuit. The second electrode of the fourth transistor T4 is electrically connected to the second electrode of the third transistor T3.

Each of the first transistor T1, the second transistor T2, the third transistor T3 and the fourth transistor may be a P-type transistor or an N-type transistor following describes an example in which the first transistor T1, the second transistor T2, the third transistor T3 and the fourth transistor T4 are all N-type transistors. The operating timing of the pixel circuit illustrated in FIG. 9 is also applicable to the pixel circuit shown in FIG. 10. As shown in FIG. 9 and FIG. 10, in the data write phase t1, a high level signal is input through the first scan signal input end Scan1, the first transistor T1 and the fourth transistor T4 are turned on, and the data voltage input through the data voltage input end Vdata is written into the storage module 120 by the turned-on first transistor T1. At the same time, the initialization voltage is inputted through the voltage input end Vref and transmitted to the first end of the first resistor R1 by the turned-on fourth transistor T4. Accordingly, the potential of the first end of first resistor R1, namely the potential of the N1 node, can be initialized. In this way, when the storage module 120 is discharged, the potential of the first end of the first resistor R1, namely the potential of the N1 node, is the same for each frame. Thereby, the first end of the first resistor R1 does not have the residual charge of the previous frame, and a good display effect is ensured. Moreover, according to the embodiment of the present disclosure, the gate of the fourth transistor T4 is electrically connected to the first scan signal input end Scan1, so that the gate of the fourth transistor T4 and the gate of the first transistor T1 can be connected to the same scanning line. Accordingly, the display panel including the pixel the circuit does not require additional control signal lines, and thereby the layout of the display panel including the pixel circuit is simplified.

Figure 11:
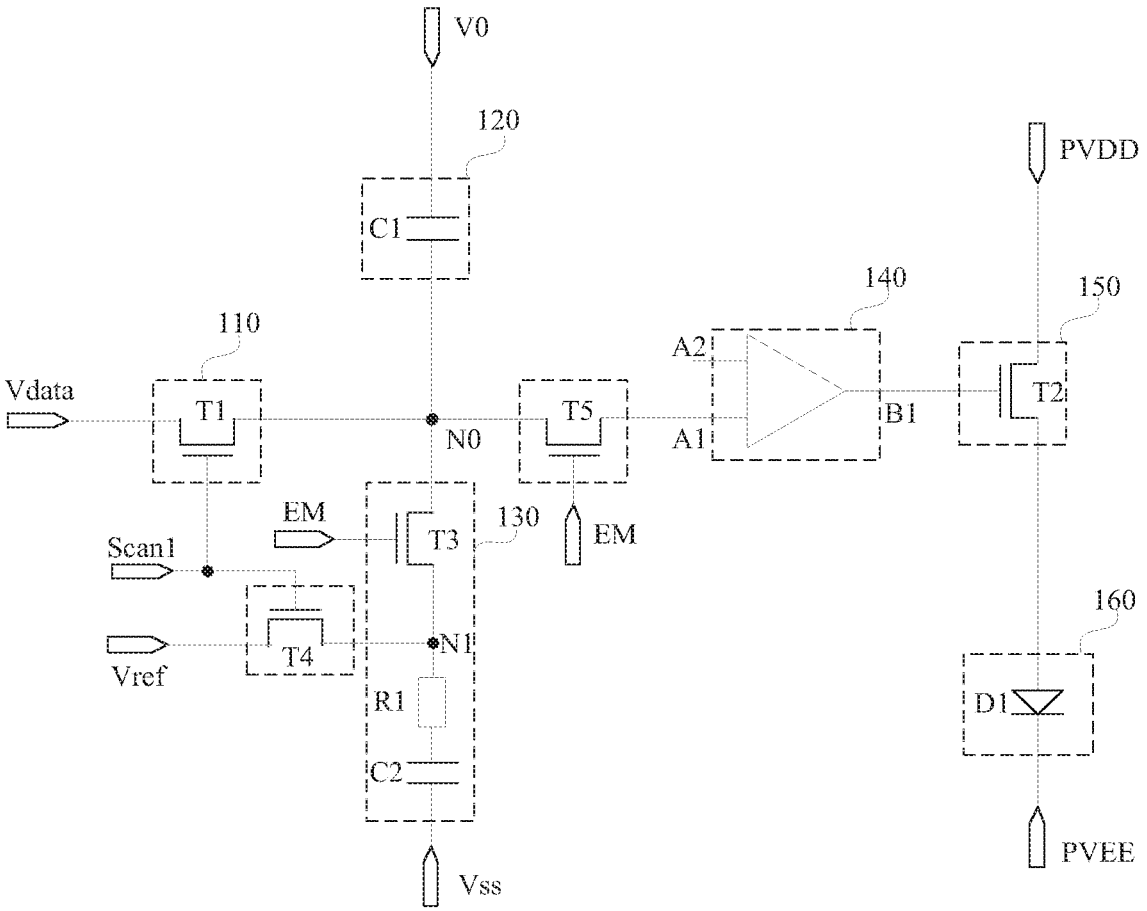
FIG. 11 is a schematic diagram of another pixel circuit according to an embodiment of the present disclosure.

FIG. 11 is a structural diagram of another pixel circuit according to an embodiment of the present disclosure. As shown in FIG. 11, on the basis of the foregoing solution, optionally, the pixel circuit further includes a fifth transistor T5. The gate of the fifth transistor T5 is electrically connected to the discharge control signal input end EM of the pixel circuit. The first electrode of the fifth transistor T5 is electrically connected to the first end of the storage module 120. The second electrode of the fifth transistor T5 is electrically connected to the first input end A1 of the comparison module 140.

Each of the first transistor T1, the second transistor T2, the third transistor T3, the fourth transistor T4 and the fifth transistor T5 may be a P-type transistor or an N-type transistor. The following describes an example in which the first transistor T1, the second transistor T2, the third transistor T3, the fourth transistor T4 and the fifth transistor T5 are all N-type transistors. The operating timing of the pixel circuit illustrated in FIG. 9 is also applicable to the pixel circuit shown in FIG. 11. Referring to FIG. 9 and FIG. 11, the data write phase t1 of the pixel circuit shown in FIG. 11 is the same as that of the pixel circuit shown in FIG. 10, and details are not described herein again. In the light-emitting phase t2, the discharge control signal input end EM receives a high level signal, and the third transistor T3 and the fifth transistor T5 are turned on simultaneously, so that the storage module 120 is discharged by the discharge module 130 and the data voltage stored in the storage module 120 is input to the first input terminal A1 of the comparison module 140 simultaneously. Therefore, the voltage is input to the first input end A1 of the comparison when the discharge module 130 starts to discharge, the light emission duration of the light-emitting module 160 is accurately controlled for each gray scale, thereby ensuring the good display effect of the display panel including the pixel circuit.

Figure 12:
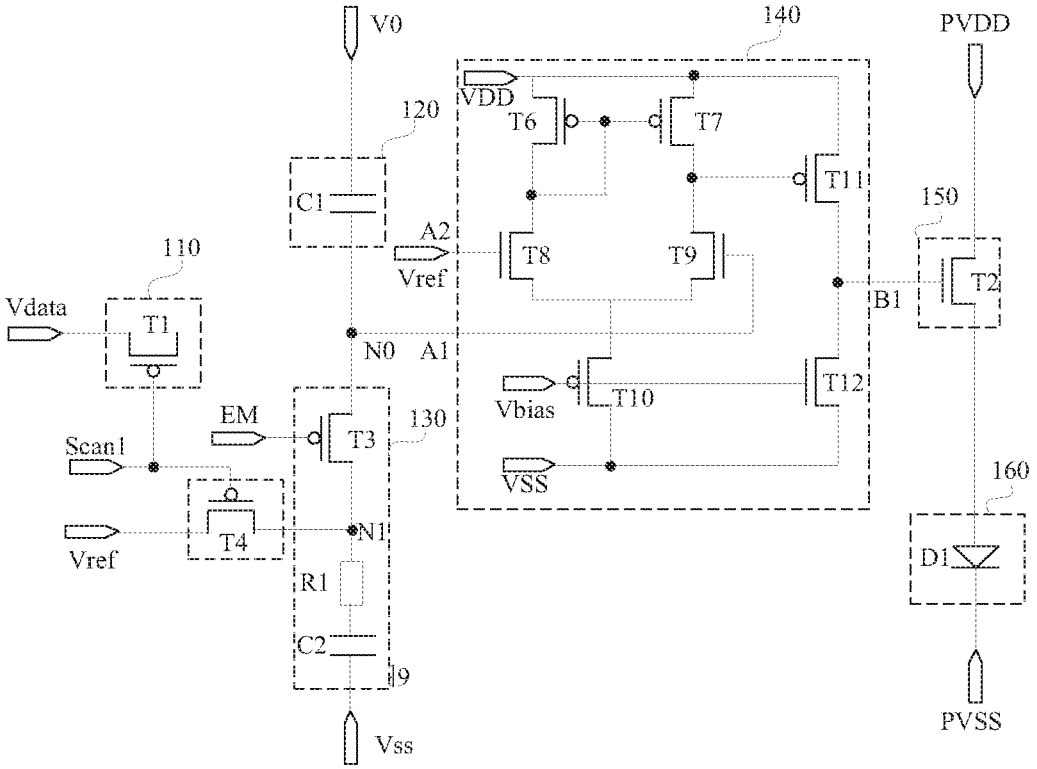
FIG. 12 is a schematic diagram of another pixel circuit according to an embodiment of the present disclosure.

FIG. 12 is a schematic diagram of another pixel circuit according to an embodiment of the present disclosure. As shown in FIG. 12, the comparison module 140 includes a sixth transistor T6, a seventh transistor T7, an eighth transistor T8, a ninth transistor T9, a tenth transistor T10, an eleventh transistor T11 and a twelfth transistor T12. The sixth transistor T6 and the seventh transistor T7 are same in channel type, the eighth transistor T8 is and the ninth transistor T9 are same in channel type, and the sixth transistor T6 and the eighth transistor T8 are different in channel type.

The gate of the sixth transistor T6 is electrically connected to the gate of the seventh transistor T7. The first electrode of the sixth transistor T6 is electrically connected to the fifth voltage signal input end VDD of the pixel circuit. The second electrode of the sixth transistor T6 is electrically connected to the first ode of the eighth transistor T8. The gate of the sixth transistor is further electrically connected to the second electrode of the sixth transistor T6.

The gate of the eighth transistor T8 serves as the second input end A2 of the comparison module 140. The second electrode of the eighth transistor T8 is electrically connected to the second electrode of the ninth transistor T9.

The first electrode of the seventh transistor T7 is electrically connected to a fifth voltage signal input end VDD of the pixel circuit. The second electrode of the seventh transistor T7 is electrically connected to the first electrode of the ninth transistor T9. The gate of the ninth transistor T9 serves as the first input end A1 of the comparison module 140.

The gate of the tenth transistor T10 is electrically connected to a sixth voltage signal input end Vbias of the pixel circuit. The first electrode of the tenth transistor T10 is electrically connected to the common end of the second electrode of the eighth transistor T8 and the second electrode of the ninth transistor T9. The second electrode of the tenth transistor T10 is electrically connected to a seventh voltage signal input end VSS of the pixel circuit.

The gate of the eleventh transistor T11 is electrically connected to the common end of the second electrode of the seventh transistor T7 and the first electrode of the ninth transistor T9. The first electrode of the eleventh transistor T11 is electrically connected to the fifth voltage signal input end VDD of the pixel circuit. The second electrode of the eleventh transistor T11 is electrically connected to the first electrode of the twelfth transistor T12.

The gate of the twelfth transistor T12 is electrically connected to the sixth voltage signal input end Vbias of the pixel circuit. The second electrode of the twelfth transistor T12 is electrically connected the seventh voltage signal input end VSS of the pixel circuit.

The common end of the second electrode of the eleventh transistor T11 and the first electrode of the twelfth transistor T12 serves as the output end B1 of the comparison module 140.

In the specific structure of the comparison module 140 in the pixel circuit illustrated in FIG. 12, when the voltage applied to the gate of the ninth transistor T9 is higher than the reference voltage applied to the gate of the eighth transistor T8, the comparison module 140 outputs the first voltage for turning on the drive module 150; and when the voltage applied to the gate of the ninth transistor T9 is lower than the reference voltage applied to the gate of the eighth transistor T8, the comparison module 140 outputs the second voltage for turning off the drive module 150. Accordingly, in the pixel circuit, for different data voltages inputted through the data voltage write module 110, the discharging durations required for decreasing the voltage at the first input end A1 to the reference voltage are different, and the turned-on durations of the drive module 150 are different. For different data voltages, the turned-on drive module 150 generates the same drive current, and the light-emitting module 160 is driven by the same drive current. Therefore, the display gray scale is modulated by the light emission duration of the light-emitting module 160.

Figure 13:
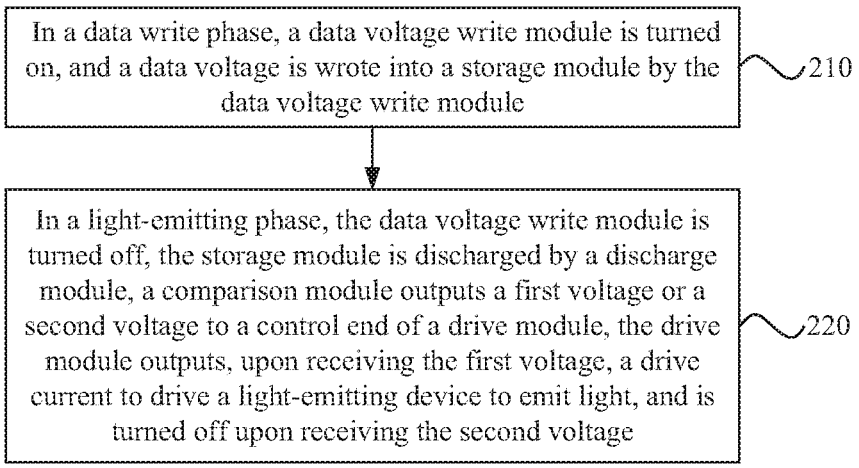
FIG. 13 is a flowchart of a drive method of a pixel circuit according to an embodiment of the present disclosure.

An embodiment of the present disclosure provides a drive method for driving a pixel circuit. FIG. 13 is a flowchart of a drive method for driving a pixel circuit according to an embodiment of the present disclosure. The method in FIG. 13 may be used for driving the pixel circuit in FIG. 1. As shown in FIG. 1, the pixel circuit includes a data voltage write module 110, a storage module 120, a discharge module 130, a comparison module 140, a drive module 150 and a light-emitting module 160.

The data voltage write module 110 is electrically connected to the storage module 120. The data voltage write module 110 is configured to transmit a data voltage to the storage module 120. The storage module 120 is configured to store the data voltage.

The discharge module 130 is electrically connected to the storage module 120. The discharge module 130 is configured to discharge the storage module 120.

The comparison module 140 includes a first input end A1, a second input end A2 and an output end B1. The first input end A1 is electrically connected to the common end N0 of the storage module 120 and the discharge module 130. The second input end A2 is configured to receive a reference voltage. The output end B1 of the comparison module 140 is electrically connected to a control end G1 of the drive module 150.

The drive method includes the steps described below.

In step 210, in a data write phase, the data voltage write module is turned on; and the data voltage is written to the storage module by the data voltage write module.

In step 220, in a light-emitting phase, the data voltage write module is turned off; the discharge module discharges the storage module; the comparison module outputs a first voltage or a second voltage to the control end of the drive module; the drive module outputs, upon receiving the first voltage, a drive current to drive the light-emitting element to emit light, and is turned off upon receiving the second voltage.

In the drive method of the present disclosure, in the light-emitting phase, the discharge module discharges the storage module; and the comparison module compares the voltage at the first input end with the reference voltage at the second input end and outputs a constant voltage for turning on the drive module turned on or a voltage for turning off the drive module to the control end of the drive module, so that the drive module has a constant drive current when turned on. Different display gray scales correspond to different data voltages and correspond to different turned-on durations of the drive module. The display gray scale of the light-emitting module is modulated through the turned-on duration of the drive module, namely the light emission duration for the light-emitting module. The constant drive voltage outputted by the comparison module causes the drive module to generate a large drive current. The high luminous efficiency of the inorganic light-emitting diode can be fully utilized accordingly. In this way, the inorganic light-emitting diode has a high luminous efficiency in any gray scale including the low gray scale.

In the embodiment shown in FIG. 10, on the basis of the foregoing solution, the discharge module 130 includes a third transistor T3, a first resistor R1 and a second capacitor C2 connected in series in sequence. The gate of the third transistor T3 serves as the control end of the discharge module and is electrically connected to the discharge control signal input end EM of the pixel circuit. The first electrode of the third transistor T3 serves as the first end of the discharge module 130 and is electrically connected to the first end of the storage module 120. The second electrode of the third transistor T3 is electrically connected to the first end of the first resistor R1. The second end of the first resistor R1 is electrically connected to the first end of the second capacitor C2. The second end of the second capacitor C2 serves as the second end of the discharge module 130 and is electrically connected to the second voltage signal input end PVEE of the pixel circuit.

The pixel circuit further includes an initialization module 170. The initialization module 170 includes a fourth transistor T4. The gate of the fourth transistor T4 is electrically connected to the first scanning signal input end Scan1 of the pixel circuit. The first electrode of the fourth transistor T4 is electrically connected to the initialization voltage input end Vref of the pixel circuit. The second electrode of the fourth transistor T4 is electrically connected to the second electrode of the third transistor T3.

The drive method farther includes the step described below.

In the data write phase, the fourth transistor is turned on by a first control signal that is input through the first scan signal input end; and then the first end of the first resistor is initialized.

In the data write phase, the fourth transistor is turned on, that is, the initialization module is turned on so that the initialization module can initialize the potential of the first end of the first resistor R1. In this way, in each frame, when the storage module starts to be discharged, the potential of the first end of the first resistor R1 is the same. This prevents the residual charge of the previous frame at the first end of the first resistor R1, namely the potential of the N1 node, which may affect the discharge duration. Accordingly, the current display frame is not affected by the residual charge of the previous frame so that a good display effect is ensured.

In conjunction with the foregoing embodiment shown in FIG. 11, on the basis of the foregoing solution, optionally, the pixel circuit further includes a fifth transistor T5. The gate of the fifth transistor T5 is electrically connected to the discharge control signal input end EM of the pixel circuit. The first electrode of the fifth transistor T5 is electrically connected to the first end of the storage module 120. The second electrode of the fifth transistor T5 is electrically connected to the first input end A1 of the comparison module 140.

The drive method further includes the step described below.

In the light-emitting phase, the third transistor and the fifth transistor are turned on simultaneously by a second control signal that is input to the gate of the third transistor and the gate of the fifth transistor through the discharge control signal input end.

In the light-emitting phase, the third transistor and the fifth transistor are turned on simultaneously, so that the discharge of the storage module by the discharge module and the comparison operation of the comparison module are started simultaneously. Without the third transistor and the fifth transistor, the comparison operation of the comparison module starts before the discharge of the storage module, and the light emission duration of the light-emitting module is not accurate. With the third transistor and the fifth transistor, the accurate illumination duration of the light-emitting module is ensured for each gray scale, thereby ensuring the good display effect of the display panel including the pixel circuit.

Figure 14:
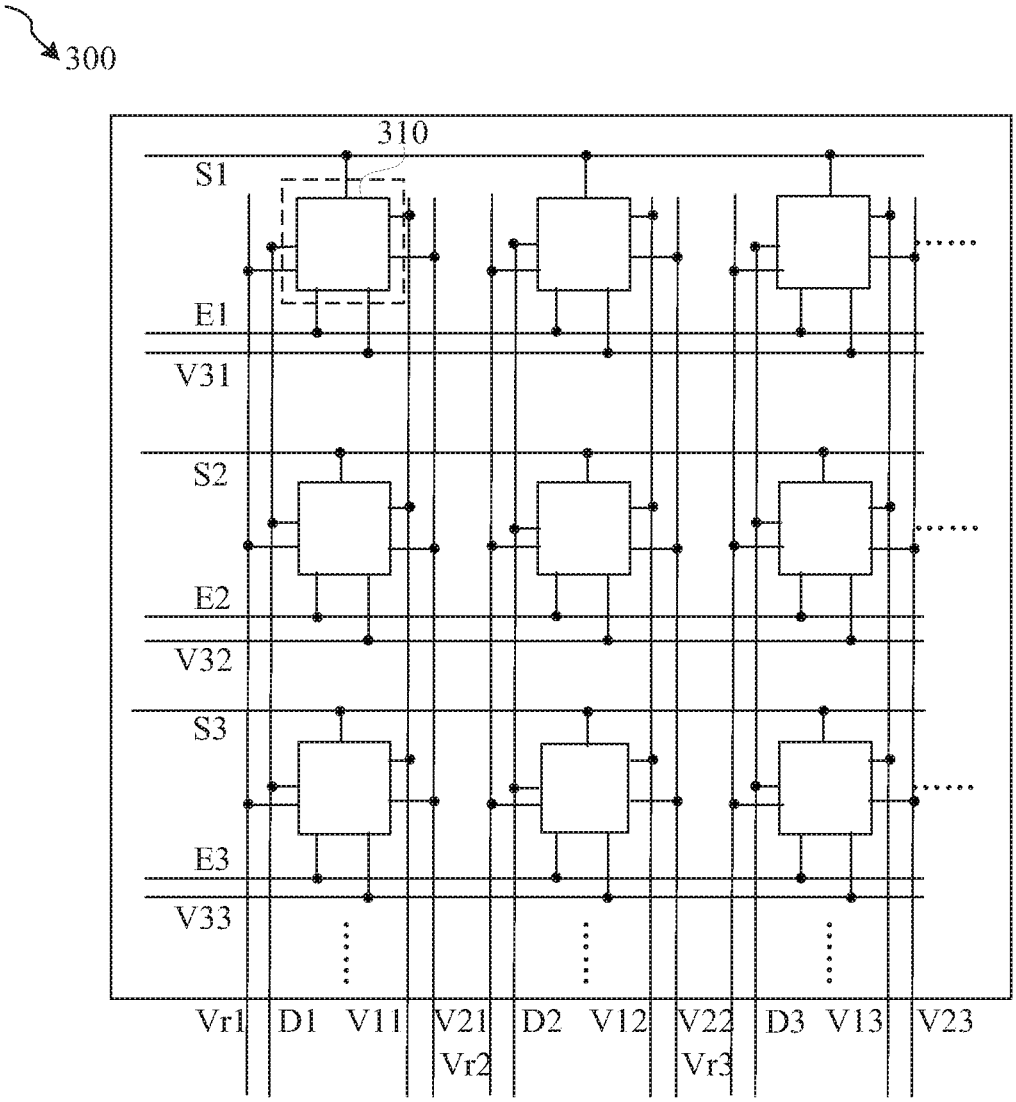
FIG. 14 is a block diagram of a display panel according to an embodiment of the present disclosure.
Figure 15:
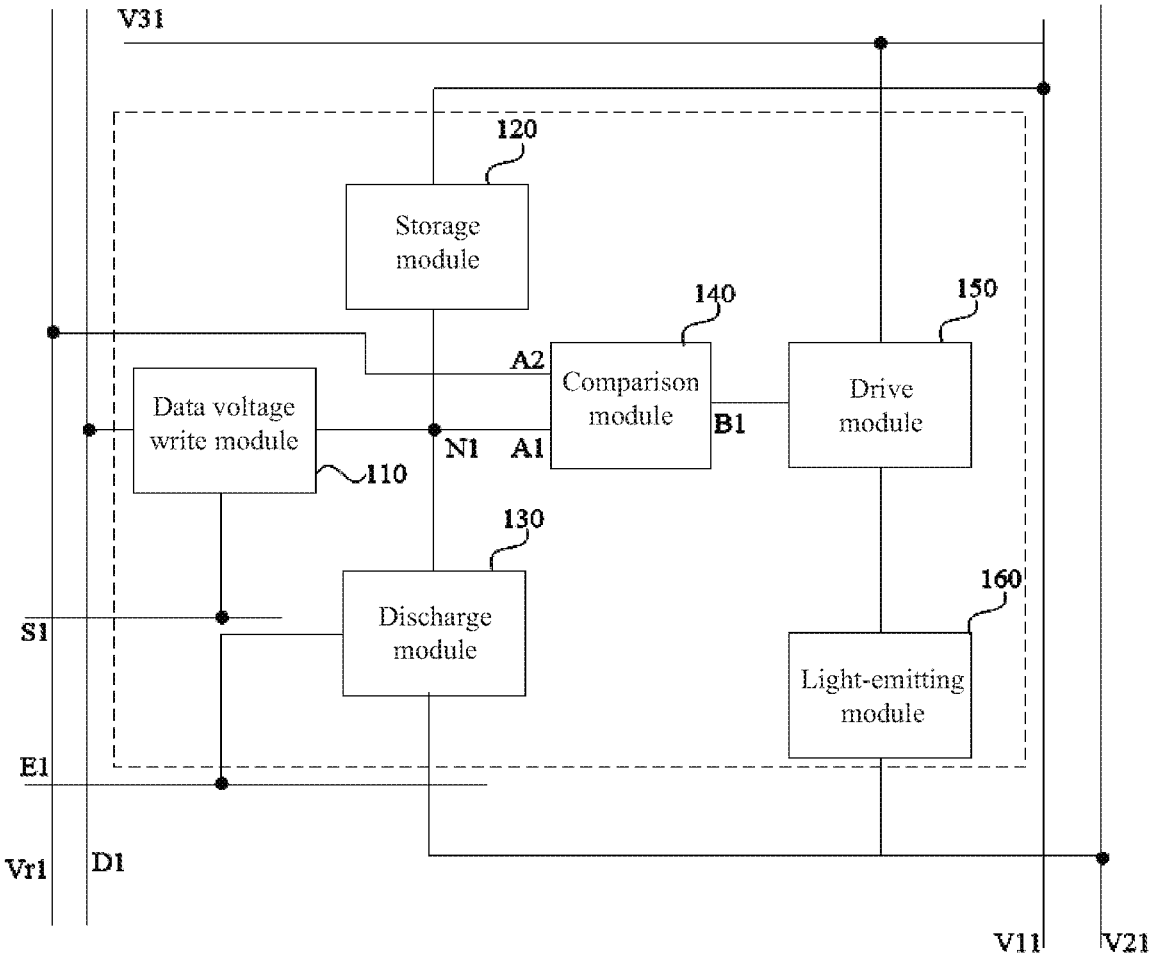
FIG. 15 is a schematic diagram illustrating the connection relationship between a pixel circuit and signal lines according to an embodiment of the present disclosure.

The present disclosure further provides a display panel. FIG. 14 is a schematic diagram of a display panel according to an embodiment of the present disclosure. FIG. 15 is a diagram illustrating the connection configuration between a pixel circuit and signal lines according to an embodiment of the present disclosure. As shown in FIG. 14 and FIG. 15, the display panel 300 includes a plurality of pixel circuits, a plurality of scanning lines (S1, S2, S3 . . . ), a plurality of data lines (D1, D2, D3 . . . ), a plurality of first voltage signal lines (V11, V12, V13 . . . ), a plurality of second voltage signal lines (V21, V22, V23 . . . ), a plurality of third voltage signal lines (V31, V32, V33 . . . ), a plurality of discharge control signal lines (E1, E2, E3 . . . ) and a plurality of reference voltage lines (Vr1, Vr2, Vr3 . . . ).

Each pixel circuit includes a data voltage write module 110, a storage module 120, a discharge module 130, a comparison module 140, a drive module 150 and a light-emitting module 160.

Each of the data voltage write module 10, the discharge module 130 and the drive module 150 includes a first end, a second end and a control end. Each of the storage module 120 and the light-emitting module 160 includes a first end and a second end. The comparison module 140 includes a first input end A1, a second input end A2 and an output end B1.

The control end of the data voltage write module 110 is electrically connected to one of the plurality of scan lines. The first end of the data voltage write module is electrically connected to one of the plurality of data lines. The second end of the data voltage write module 110 is electrically connected to the first end of the storage module 120.

The first end of the storage module 120 is electrically connected to the first end of the discharge module 130. The second end of the storage module 120 is electrically connected to one of the plurality of first voltage signal lines. The control end of the discharge module 130 is electrically connected to one of the plurality of discharge control signal lines. The second end of the discharge module 130 is electrically connected to one of the plurality of second voltage signal lines.

The first input end A1 of the comparison module 140 is electrically connected to the first end of the storage module 120. The second input end A2 of the comparison module 140 is electrically connected to one of the plurality of reference voltage lines. The output end B1 of the comparison module 140 is electrically connected to the control end G1 of the drive module 150.

The first end of the drive module 150 is electrically connected to one of the plurality of third voltage signal lines. The second end of the drive module 150 is electrically connected to the first end of the light-emitting module 160. The second end of the light-emitting module 160 is electrically connected to one of the plurality of second voltage signal lines.

As shown in FIG. 14, a plurality of sub pixels 310 is defined by intersection of the scan lines and the data lines. Each pixel circuit may be in a corresponding sub pixel 310.

FIG. 15 shows the connection relationship between signal lines and the pixel circuit in the sub pixel 310 in FIG. 14.

The display panel in the embodiment of the present disclosure includes the plurality of pixel circuits. Each pixel circuit includes the data voltage write module, the storage module, the discharge module, the comparison module, the drive module and the light-emitting module. The discharge module is electrically connected to the storage module. The comparison module includes the first input end, the second input end and the output end. The first input end is electrically connected to the common end of the storage module and the discharge module. The second input end is configured to receive the reference voltage. The output end of the comparison module is electrically connected to the control end of the drive module. In the light-emitting phase, the discharge module discharges the storage module; and the comparison module compares the voltage at the first input end with the reference voltage at the second input end and outputs a constant voltage for turning on the drive module or a voltage for turning off the drive module to the control end of the drive module, so that the drive module has a constant drive current when turned on. Different display gray scales correspond to different data voltages and correspond to different turned-on durations of the drive module. The display gray scale of the light-emitting module is modulated through the turned-on duration of the drive module, namely the light emission duration for the light-emitting module. The constant drive voltage outputted by the comparison module causes the drive module to generate a large drive current. The high luminous efficiency of the inorganic light-emitting diode can be fully utilized accordingly. In this way, the inorganic light-emitting diode has a high luminous efficiency in any gray scale including the low gray scale.

Figure 16:
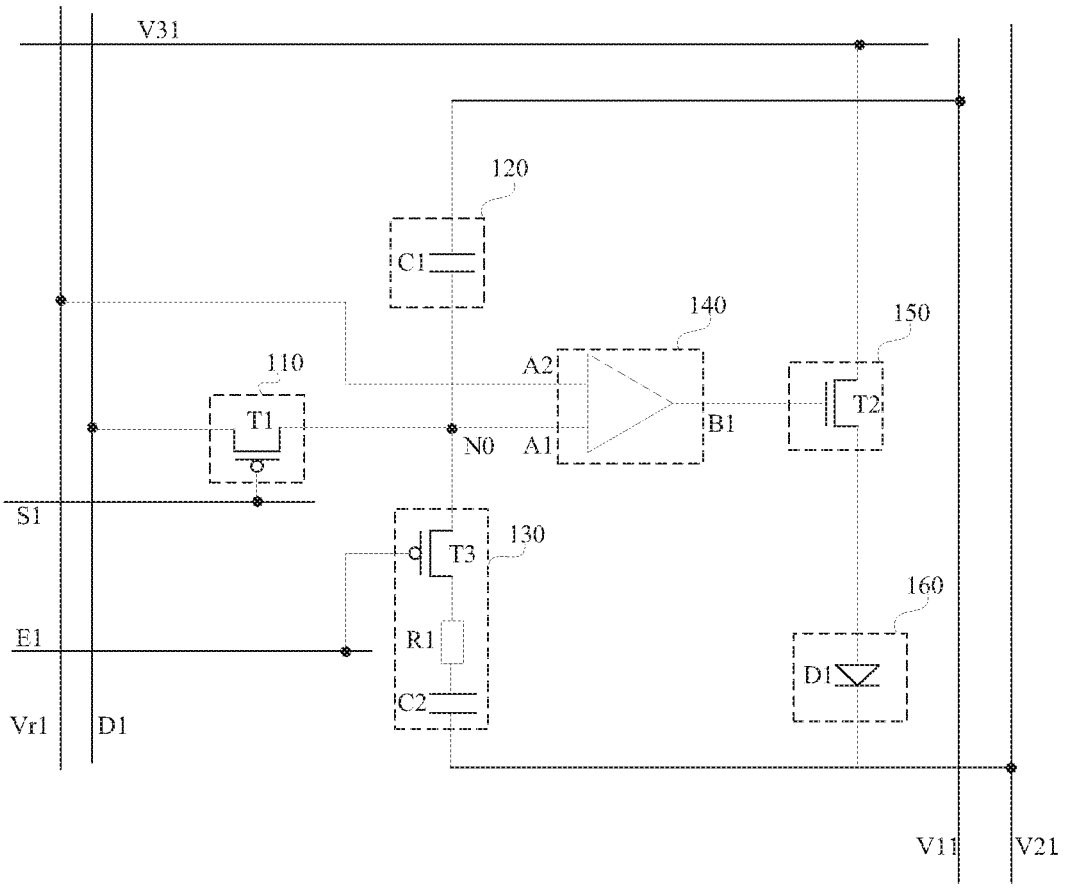
FIG. 16 is a schematic diagram illustrating the connection relationship between a pixel circuit and signal lines according to another embodiment of the present disclosure.

FIG. 16 is a schematic diagram illustrating another connection configuration between the pixel circuit and signal lines according to an embodiment of the present disclosure. FIG. 16 shows the connection relationship between the signal lines and the pixel circuit in the sub pixel 310 in FIG. 14. As shown in FIG. 14 and FIG. 16, on the basis of foregoing solution, optionally, the data voltage write module 110 includes a first transistor T1. The storage module 120 includes a first capacitor C1. The discharge module 130 includes a third transistor T3, a first resistor R1 and a second capacitor C2 connected in series.

The gate of the first transistor T1 is electrically connected to the scan line S1. The first electrode of the first transistor T1 is electrically connected to the data line D1. The second electrode of the first transistor T1 is electrically connected to the first end of the first capacitor C1.

The first end of the first capacitor C1 is electrically connected to the first electrode of the third transistor T3. The second end of the first capacitor C1 is electrically connected to the first voltage signal line V11. The gate of the third transistor T3 is electrically connected to the discharge control signal line E1. The second electrode of the third transistor T3 is connected to the first end of the first resistor R1. The second end of the first resistor R1 is electrically connected to the first end of the second capacitor C2. The second end of the second capacitor C2 is electrically connected to the second voltage signal line V21.

The first input end A1 of the comparison module 140 is electrically connected to the first end of the first capacitor C1. The output end B1 of the comparison module 140 is electrically connected to the gate of the second transistor T2. The first electrode of the second transistor T2 is electrically connected to the third voltage signal line V31. The second electrode of the second transistor T2 is electrically connected to the first end of the light-emitting module 160. The second end of the light-emitting module 160 is electrically connected to the second voltage signal line V21.

Figure 17:
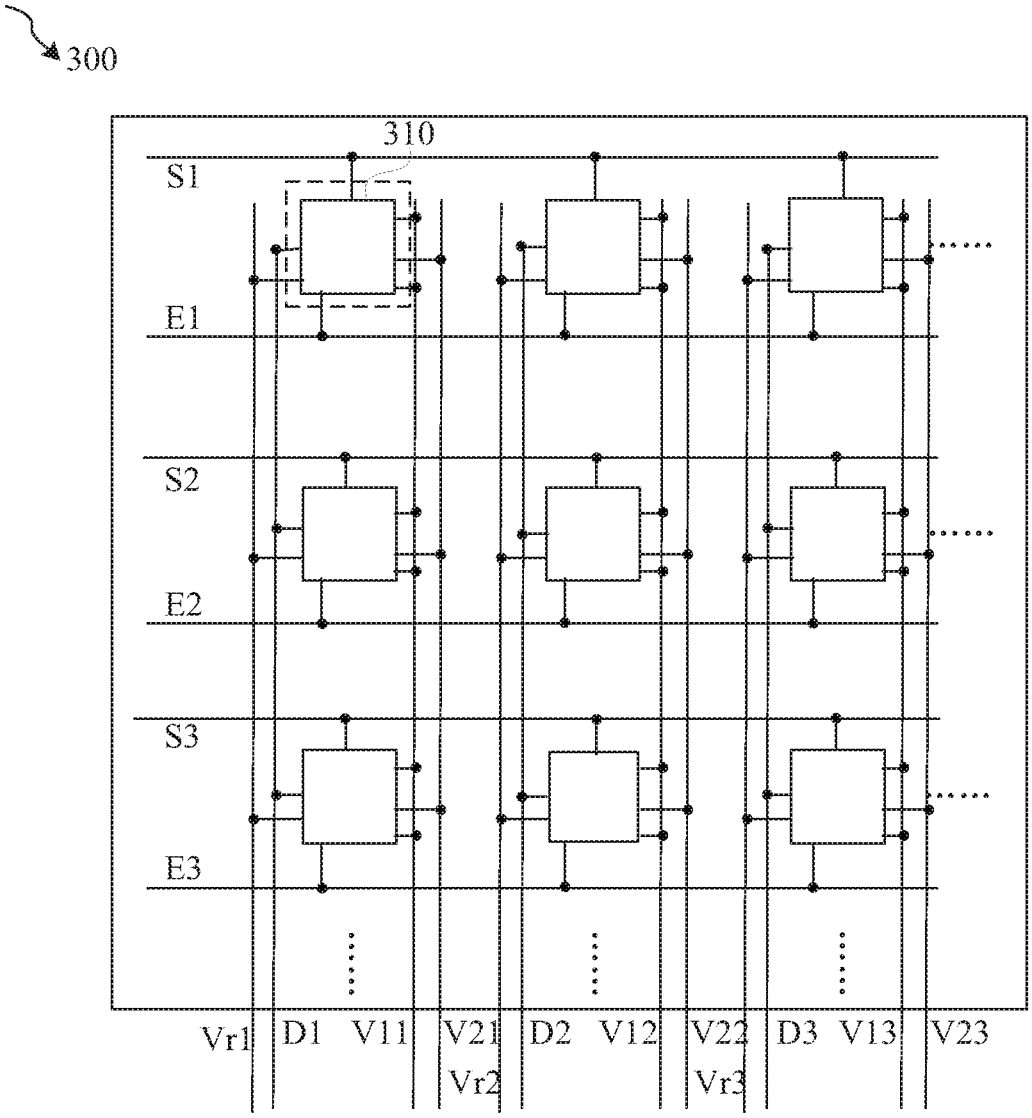
FIG. 17 is a block diagram of another display panel according to an embodiment of the present disclosure.
Figure 18:
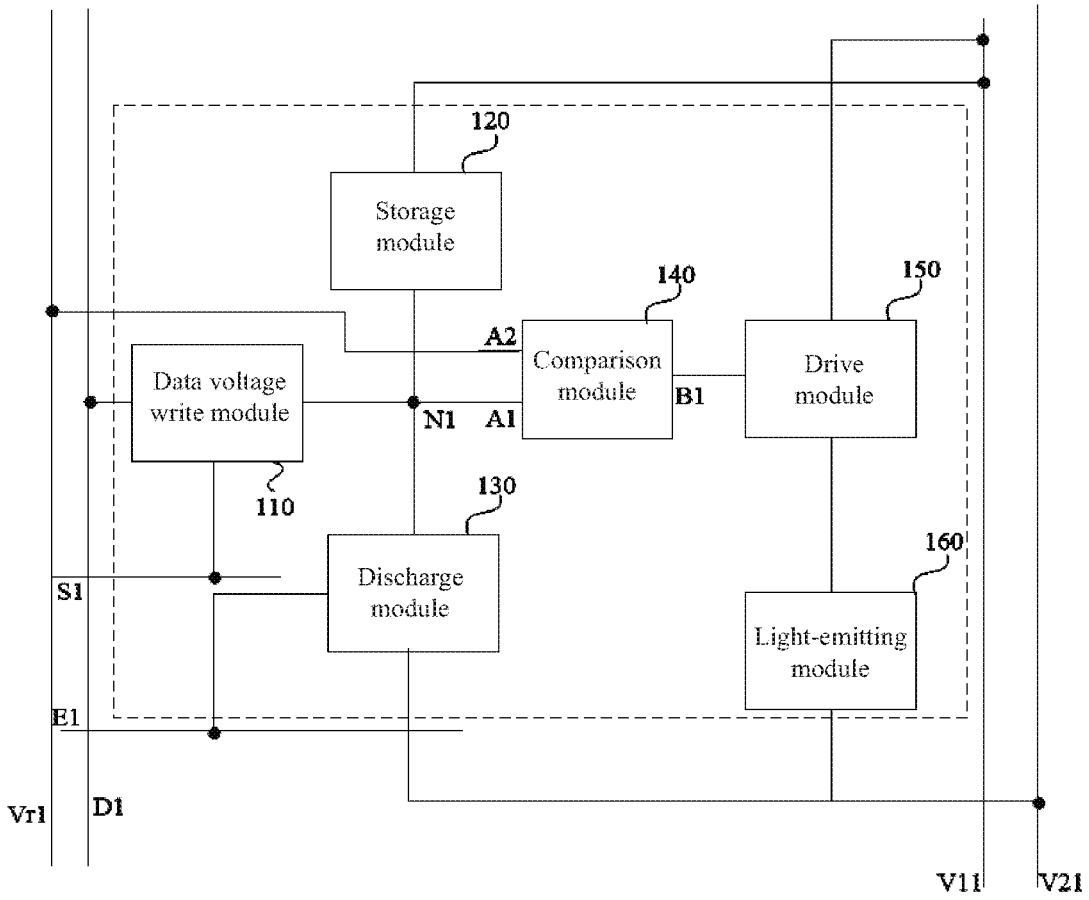
FIG. 18 is a schematic diagram of an exemplary pixel circuit in a display panel.

FIG. 17 is a structural diagram of another display panel according to an embodiment of the present disclosure. FIG. 18 is a diagram illustrating the connection configuration between the pixel circuit and signal lines according to an embodiment of the present disclosure. As shown in FIG. 17, the scan lines and the data lines intersect and define a plurality of sub pixels. Each pixel circuit is in a respective one of the sub pixels. FIG. 18 shows the connection relationship between the signal lines and the pixel circuit in the sub pixel 310 in FIG. 17. As shown in FIG. 17 and FIG. 18, the first voltage signal line and the third voltage signal line electrically connected to the same pixel are the same voltage signal line. That is, the same pixel circuit, the first end of the drive module 160 and the second end of the storage module 120 are electrically connected to the same voltage signal line (for example, V11 in FIG. 18), thereby reducing the number of signal lines in the display panel and reduce the layout difficulty of the display panel.

Figure 19:
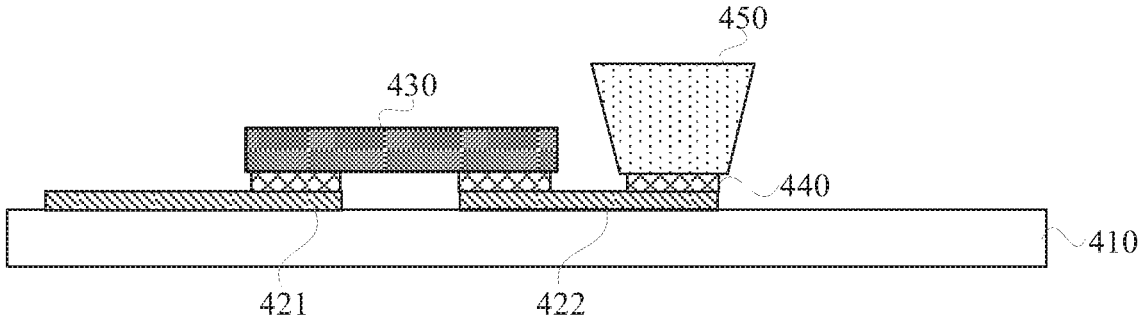
FIG. 19 is a sectional view of another display panel according to an embodiment of the present disclosure.

FIG. 19 is a structural diagram of another display panel according to an embodiment of the present disclosure. As shown in FIG. 19, the display further includes a substrate 410. The first capacitor 421 and the second capacitor 422 are formed on the substrate 410. The first resistor, the first transistor, the second transistor, the third transistor and the comparison module are integrated in a micro integrated circuit 430. The micro integrated circuit 430 is bound to the side, where the first capacitor 421 and the second capacitor 422 are formed, of the substrate 410.

FIG. 18 illustrates a structure of one pixel circuit in the display panel. The substrate 410 can provide functions of buffering, protection and support for the entire display panel. Therefore, the area of the substrate 410 is large. The substrate 410 may be, for example, a flexible substrate or a glass substrate. The area occupied by the capacitor is relatively large while the sizes of the integrated circuit are relatively small. If the capacitor is disposed on the integrated circuit, the manufacture is difficult, and the capacitor occupies quite a large area of the integrated circuit, thereby leaving a relatively small space for other elements in the integrated circuit and affecting the performance of the integrated circuit. The sizes of the substrate 410 are very large. In the present embodiment, the first capacitor 421 and the second capacitor 422 are disposed on the substrate 410, so that the difficulty in manufacturing the capacitor can be reduced and the space available for elements in the integrated circuit can be larger, thereby improving the performance of the integrated circuit. Moreover, the integrated circuit has a relatively high manufacturing capability. The first resistor, the first transistor, the second transistor, the third transistor and the comparison module are integrated in the micro integrated circuit 430, so that the sizes of the resistor, the transistor and the comparison module can be reduced. This helps reduce the sizes of the pixel circuit and increase the pixel density. The display panel further includes a binding pad 440. The first capacitor 421 and the second capacitor 422 may be connected to the micro integrated circuit 430 through the binding pad 440. The light-emitting module 450 may be connected to other elements in the pixel circuit through the binding pad 440. In the manufacturing process of the display panel, the micro integrated circuit 430 may be transferred to the glass substrate 410 and bound to other elements in the pixel circuit. It should be noted that FIG. 19 just illustrates the structure of the pixel circuit in the display panel. Positions of the first capacitor 421 and the second capacitor 422 in the pixel and connections between the pixel circuit elements in the micro integrated circuit 430 and the light-emitting module 450 are not limited to the manner illustrated in FIG. 19. The positions of the first capacitor 431 and the second capacitor 432 may be interchanged as long as the connection relationship of the pixel circuit according to the embodiment of the present disclosure is implemented. Moreover, wires for connecting the elements in the pixel circuit may be disposed on the substrate 410.

Figure 20:
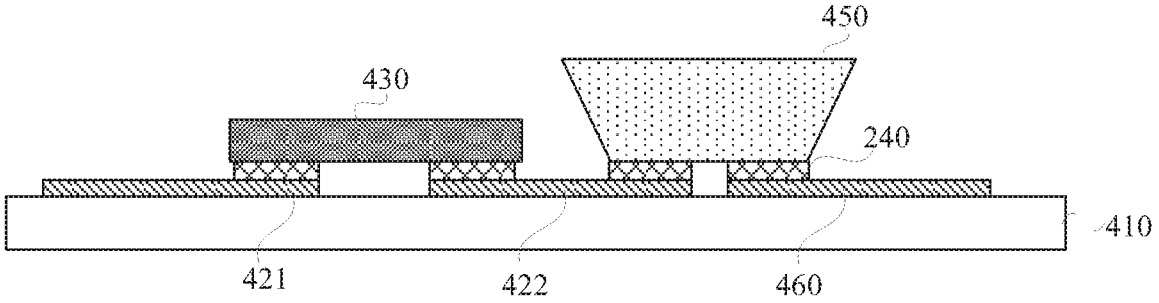
FIG. 20 is a sectional view of another display panel according to an embodiment of the present disclosure.

FIG. 20 is a structural diagram of another display panel according to an embodiment of the present disclosure. As shown in FIG. 20, on the basis of the foregoing solution, optionally, the display further includes a substrate 410. The first transistor, the second transistor, the third transistor, the first capacitor 421 and the second capacitor 422 are disposed on the substrate 410. The comparison module is integrated in a micro integrated circuit 430. The micro integrated circuit 430 is bound to the side, where the first capacitor 421 and the second capacitor 422 are disposed, of the substrate 410.

FIG. 20 illustrates a structure of one pixel circuit in the display panel. The structure 460 in FIG. 20 may include the first transistor, the second transistor, the third transistor and the first resistor. The substrate 410 is very large. By disposing the first transistor, the second transistor, the third transistor, the first resistor, the first capacitor 421 and the second capacitor 422 on the substrate 410, the difficulty in manufacturing the first transistor, the second transistor, the third transistor, the first resistor, the first capacitor 421 and the second capacitor 422 can be reduced. Since the integrated circuit has a high manufacturing capability, integration of the comparison module into the micro integrated circuit 430 helps reduce the sizes of the pixel circuit, thereby increasing the pixel density. Moreover, in the display panel according to the present embodiment, the micro integrated circuit 430 includes only the comparison module, so that the space available for the comparison module is relatively large, and the difficulty in manufacturing the comparison module is reduced. The display panel further includes a binding pad 240. The micro integrated circuit may be connected to other elements in the pixel circuit which are disposed on the substrate through the bonding pad 240. In the manufacture process of the display panel, the micro integrated circuit 430 may be transferred to the glass substrate 410 and bound to other elements in the pixel circuit.

Optionally, in the display panel according to any of the foregoing embodiments, the substrate 410 is a glass substrate 410. Compared with the flexible substrate, the glass substrate has greater support strength and facilitates the manufacture of the first capacitor 421, the second capacitor 422 or other elements on the substrate 410.

Figure 21:
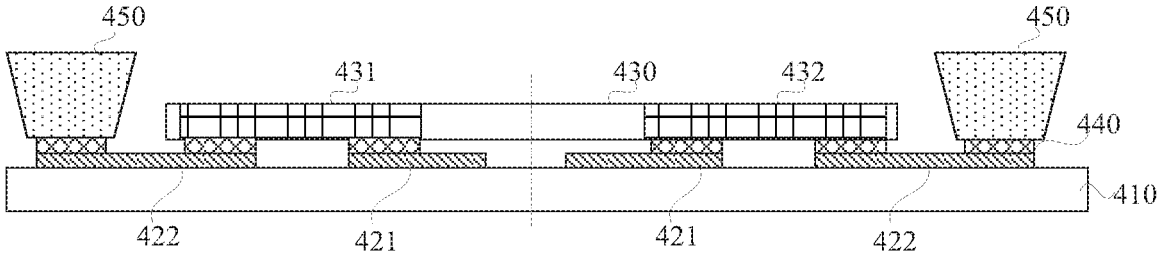
FIG. 21 is a sectional view of another display panel according to an embodiment of the present disclosure.

FIG. 21 is a structural diagram of another display panel according to an embodiment of the present disclosure. Referring to FIG. 21, optionally, at least two comparison modules are integrated into one micro integrated circuit. Each comparison module is connected in one pixel circuit. FIG. 21 illustrates an exemplary display panel in which one micro integrated circuit 430 includes two comparison modules in two pixel circuits. Referring to FIG. 21, one pixel circuit is disposed on the left side of the dashed line and another pixel circuit is disposed on the right side of the dashed line, the first comparison module 431 and the second comparison module 432 are integrated into one micro integrated circuit, and the first comparison module 431 belongs to the left pixel circuit and the second comparison module 432 belongs to the right pixel circuit. At least two pixel circuits shared one micro integrated circuit, that is, the comparison modules of at least two pixel circuits are integrated into one micro integrated circuit, so that the number of micro integrated circuits 430 can be reduced, and thereby the transfer of the micro integrated circuit 430 is simpler and more convenient and the micro integrated circuit has a higher integration level.

It is to be noted that the above are merely exemplary embodiments of the present disclosure and the technical principles used therein. It will be understood by those skilled in the art that the present disclosure is not limited to the specific embodiments described herein. Those skilled in the art can make various apparent modifications, adaptations and substitutions without departing from the scope of the present disclosure. Therefore, while the present disclosure has been described in detail through the above-mentioned embodiments, the present disclosure is not limited to the above-mentioned embodiments and may include more other equivalent embodiments without departing from the concept of the present disclosure. The scope of the present disclosure is determined by the scope of the appended claims.

What is claimed is:

1. A pixel circuit, comprising: a data voltage write module, a storage module, a discharge module, a comparison module, a drive module and a light-emitting module, a first scan signal input end, a data voltage input end, a first voltage signal input end, a second voltage signal input end, a discharge control signal input end, and a third voltage signal input end;

wherein the data voltage write module comprises a first transistor, the storage module comprises a first capacitor, and the drive module comprises a second transistor, wherein a gate of the first transistor is electrically connected to the first scan signal input end, a first electrode of the first transistor is electrically connected to the data voltage input end, and a second electrode of the first transistor is electrically connected directly to a first end of the first capacitor;

wherein the data voltage write module is configured to transmit a data voltage to the storage module, and the storage module is configured to store the data voltage;

wherein the first end of the first capacitor is also electrically connected directly to a first end of the discharge module, a second end of the first capacitor is electrically connected to the first voltage signal input end, a second end of the discharge module is electrically connected to the second voltage signal input end, and a control end of the discharge module is electrically connected to the discharge control signal input end;

wherein the discharge module is configured to discharge the storage module;

wherein the comparison module comprises a first input end, a second input end and an output end; the first input end of the comparison module is electrically connected directly to the first end of the first capacitor, the output end of the comparison module is electrically connected directly to a gate of the second transistor, and the second input end is configured to receive a reference voltage;

wherein a first electrode of the second transistor is electrically connected to the third voltage signal input end, and a second electrode of the second transistor is electrically connected to a first end of the light-emitting module, and a second end of the light-emitting module is electrically connected to the second voltage signal input end of the pixel circuit; and wherein the drive module is configured to drive, according to a voltage outputted through the output end of the comparison module, the light-emitting module to emit light.

2. The pixel circuit of claim 1, wherein the voltage outputted through the output end of the comparison module comprises a first voltage and a second voltage, the drive module is turned on when the output end of the comparison module outputs the first voltage, and the drive module is turned off when the output end of the comparison module outputs the second voltage.

3. The pixel circuit of claim 1, wherein the first voltage signal input end is electrically connected to the third voltage signal input end.

4. The pixel circuit of claim 1, wherein the discharge module comprises: a third transistor, a first resistor and a second capacitor connected in series in sequence;

wherein a gate of the third transistor serves as a control end of the discharge module and is electrically connected to a discharge control signal input end of the pixel circuit; a first electrode of the third transistor serves as a first end of the discharge module and is electrically connected to a first end of the storage module; a second electrode of the third transistor is electrically connected to a first end of the first resistor; a second end of the first resistor is electrically connected to a first end of the second capacitor; and a second end of the second capacitor serves as a second end of the discharge module and is electrically connected to a second voltage signal input end of the pixel circuit.

5. The pixel circuit of claim 4, further comprising an initialization module, wherein the initialization module is electrically connected to the first end of the first resistor and is configured to initialize a potential of the first end of the first resistor.

6. The pixel circuit of claim 5, wherein the initialization module comprises a fourth transistor, a gate of the fourth transistor is electrically connected to a first scan signal input end of the pixel circuit, a first electrode of the fourth transistor is electrically connected to an initialization voltage input end of the pixel circuit, and a second electrode of the fourth transistor is electrically connected to the second electrode of the third transistor.

7. The pixel circuit of claim 4, further comprising a fifth transistor, wherein a gate of the fifth transistor is electrically connected to the discharge control signal input end of the pixel circuit, a first electrode of the fifth transistor is electrically connected to the first end of the storage module, and a second electrode of the fifth transistor is electrically connected to the first input end of the comparison module.

8. The pixel circuit of claim 1, wherein the comparison module comprises a sixth transistor, a seventh transistor, an eighth transistor, a ninth transistor, a tenth transistor, an eleventh transistor and a twelfth transistor, wherein the sixth transistor and the seventh transistor are same in channel type, the eighth transistor and the ninth transistor are same in channel type, and the sixth transistor and the eighth transistor are different in channel type, wherein a gate of the sixth transistor is electrically connected to a gate of the seventh transistor, a first electrode of the sixth transistor is electrically connected to a fifth voltage signal input end of the pixel circuit, a second electrode of the sixth transistor is electrically connected to a first electrode of the eighth transistor, and the gate of the sixth transistor is further electrically connected to the second electrode of the sixth transistor;

wherein a gate of the eighth transistor serves as the second input end of the comparison module;

wherein a first electrode of the seventh transistor is electrically connected to the fifth voltage signal input end of the pixel circuit, a second electrode of the seventh transistor is electrically connected to a first electrode of the ninth transistor, a second electrode of the ninth transistor is electrically connected to a second electrode of the eighth transistor, and a gate of the ninth transistor serves as the first input end of the comparison module;

wherein a gate of the tenth transistor is electrically connected to a sixth voltage signal input end of the pixel circuit, a first electrode of the tenth transistor is electrically connected to a common end of the second electrode of the eighth transistor and the second electrode of the ninth transistor, and a second electrode of the tenth transistor is electrically connected to a seventh voltage signal input end of the pixel circuit;

wherein a gate of the eleventh transistor is electrically connected to a common end of the second electrode of the seventh transistor and the first electrode of the ninth transistor, a first electrode of the eleventh transistor is electrically connected to the fifth voltage signal input end of the pixel circuit, and a second electrode of the eleventh transistor is electrically connected to a first electrode of the twelfth transistor;

wherein a gate of the twelfth transistor is electrically connected to the sixth voltage signal input end of the pixel circuit, and a second electrode of the twelfth transistor is electrically connected to the seventh voltage signal input end of the pixel circuit; and wherein a common end of the second electrode of the eleventh transistor and the first electrode of the twelfth transistor serves as the output end of the comparison module.

9. The pixel circuit of claim 1, wherein the light-emitting module is an inorganic light-emitting diode.

10. A display panel, comprising: a plurality of pixel circuits, a plurality of scan lines, a plurality of data lines, a plurality of first voltage signal lines, a plurality of second voltage signal lines, a plurality of third voltage signal lines, a plurality of discharge control signal lines and a plurality of reference voltage lines, wherein each of the plurality of pixel circuits comprises: a data voltage write module, a storage module, a discharge module, a comparison module, a drive module and a light-emitting module;

wherein the data voltage write module comprises a first transistor; the storage module comprises a first capacitor; the drive module comprises a second transistor; and the discharge module comprises a third transistor, a first resistor and a second capacitor connected in series;

wherein a gate of the first transistor is electrically connected to a respective one of the plurality of scan lines, a first electrode of the first transistor is electrically connected to a respective one of the plurality of data lines, and a second electrode of the first transistor is electrically connected directly to a first end of the first capacitor;

wherein the first end of the first capacitor is electrically connected to a first electrode of the third transistor, a second end of the first capacitor is electrically connected to a respective one of the plurality of first voltage signal lines, a gate of the third transistor is electrically connected to a respective one of the plurality of discharge control signal lines, a second electrode of the third transistor is electrically connected to a first end of the first resistor, a second end of the first resistor is electrically connected to a first end of second capacitor, and a second end of the second capacitor is electrically connected to a respective one of the plurality of second voltage signal lines;

wherein each of the data voltage write module, the discharge module and the drive module comprises a first end, a second end and a control end; each of the storage module and the light-emitting module comprises a first end and a second end; and the comparison module comprises a first input end, a second input end and an output end;

wherein the control end of the data voltage write module is electrically connected to a respective one of the plurality of scan lines, the first end of the data voltage write module is electrically connected to a respective one of the plurality of data lines, and the second end of the data voltage write module is electrically connected to the first end of the storage module;

wherein the first end of the storage module is also electrically connected to the first end of the discharge module, the second end of the storage module is electrically connected to a respective one of the plurality of first voltage signal lines, the control end of the discharge module is electrically connected to a respective one of the plurality of discharge control signal lines, and the second end of the discharge module is electrically connected to a respective one of the plurality of second voltage signal lines;

wherein the first input end of the comparison module is electrically connected to the first end of the storage module, the second input end of the comparison module is electrically connected to a respective one of the plurality of reference voltage lines, and the output end of the comparison module is electrically connected to the control end of the drive module;

wherein the first input end of the comparison module is electrically connected to the first end of the first capacitor, the output end of the comparison module is electrically connected to a gate of the second transistor, a first electrode of the second transistor is electrically connected to one of the plurality of third voltage signal lines, and a second electrode of the second transistor is electrically connected to a first end of the light-emitting module, and a second end of the light-emitting module is electrically connected to a respective one of the plurality of second voltage signal lines; and wherein the first end of the drive module is electrically connected to a respective one of the plurality of third voltage signal lines, the second end of the drive module is electrically connected to the first end of the light-emitting module, and the second end of the light-emitting module is electrically connected to a respective one of the plurality of second voltage signal lines.

11. The display panel of claim 10, further comprising a substrate, wherein the first capacitor and the second capacitor are disposed on the substrate; the first resistor, the first transistor, the second transistor, the third transistor and the comparison module are integrated in a micro integrated circuit; and the micro integrated circuit is bound to a side, where the first capacitor and the second capacitor are disposed, of the substrate.

12. The display panel of claim 10, further comprising a substrate, wherein the first transistor, the second transistor, the third transistor, the first resistor, the first capacitor and the second capacitor are disposed on the substrate; the comparison module is integrated in a micro integrated circuit; and the micro integrated circuit is bound to a side, where the first capacitor and the second capacitor are disposed, of the substrate.

13. The display panel of claim 12, wherein at least two of the plurality of pixel circuits share one micro integrated circuit, the comparison modules in the at least two pixel circuits are integrated in the one micro integrated circuit.

14. The display panel of claim 11, wherein the substrate is a glass substrate.

15. The display panel of claim 10, wherein one of the plurality of first voltage signal lines and one of the plurality of third voltage signal lines electrically connected to a same pixel circuit is one same voltage signal line.

16. A drive method of a pixel circuit, wherein the pixel circuit comprises a data voltage write module, a storage module, a discharge module, a comparison module, a drive module, an initialization module and a light-emitting module, wherein the data voltage write module is configured to transmit a data voltage to the storage module, and the storage module is configured to store the data voltage;

wherein the discharge module is configured to discharge the storage module; the discharge module comprises a third transistor, a first resistor and a second capacitor connected in series in sequence; wherein a gate of the third transistor serves as a control end of the discharge module and is electrically connected to a discharge control signal input end of the pixel circuit, a first electrode of the third transistor serves as a first end of the discharge module and is electrically connected to a first end of the storage module, a second electrode of the third transistor is electrically connected to a first end of the first resistor, a second end of the first resistor is electrically connected to a first end of the second capacitor, and a second end of the second capacitor serves as a second end of the discharge module and is electrically connected to a second voltage signal input end of the pixel circuit;

the initialization module comprises a fourth transistor, a gate of the fourth transistor is electrically connected to a first scan signal input end of the pixel circuit, a first electrode of the fourth transistor is electrically connected to an initialization voltage input end of the pixel circuit, and a second electrode of the fourth transistor is electrically connected to the second electrode of the third transistor;

wherein the comparison module comprises a first input end, a second input end and an output end; wherein the second input end is configured to receive a reference voltage; and wherein the drive method comprises:

in a data write phase, controlling the data voltage write module to be turned on; writing the data voltage to the storage module through the data voltage write module; and turning on the fourth transistor by inputting a first control signal to the fourth transistor through the first scan signal input end; and then initializing the first end of the first resistor; and in a light-emitting phase, controlling the data voltage write module to be turned off; the discharge module discharging the storage module; the comparison module outputting a first voltage or a second voltage to the control end of the drive module; upon receiving the first voltage, the drive module outputting a drive current to the light-emitting module to drive the light-emitting module to emit light; and upon receiving the second voltage, the drive module being turned off.

17. The drive method of claim 16, wherein the pixel circuit further comprises a fifth transistor, a gate of the fifth transistor is electrically connected to the discharge control signal input end of the pixel circuit, a first electrode of the fifth transistor is electrically connected to the first end of the storage module, and a second electrode of the fifth transistor is electrically connected to the first input end of the comparison module; and wherein the drive method further comprises:

in the light-emitting phase, simultaneously turning on the third transistor and the fifth transistor by inputting a second control signal to the gate of the third transistor and the gate of the fifth transistor through the discharge control signal input end.

* * * * *